US008672724B2

(12) United States Patent
Beuerle

(10) Patent No.: US 8,672,724 B2
(45) Date of Patent: Mar. 18, 2014

(54) CONVERTIBLE SLIPCOVER AND METHOD FOR CONVERTIBLE STUFFED ANIMAL AND PILLOW

(76) Inventor: Stephen Charles Beuerle, San Diego, CA (US)

( * ) Notice: Subject to any disclaimer, the term of this patent is extended or adjusted under 35 U.S.C. 154(b) by 0 days.

(21) Appl. No.: 13/520,784

(22) PCT Filed: Oct. 31, 2011

(86) PCT No.: PCT/US2011/058613

§ 371 (c)(1),
(2), (4) Date: Jul. 5, 2012

(87) PCT Pub. No.: WO2012/061302

PCT Pub. Date: May 10, 2012

(65) Prior Publication Data

US 2012/0289116 A1 Nov. 15, 2012

Related U.S. Application Data

(63) Continuation-in-part of application No. 29/402,891, filed on Sep. 28, 2011, now Pat. No. Des. 663,151, which is a continuation-in-part of application No. 29/399,394, filed on Aug. 12, 2011, now Pat. No. Des. 670,121, which is a continuation-in-part of application No. 29/386,330, filed on Feb. 28, 2011, now Pat. No. Des. 660,069.

(60) Provisional application No. 61/408,990, filed on Nov. 1, 2010, provisional application No. 61/412,737, filed on Nov. 11, 2010, provisional application No. 61/414,752, filed on Nov. 17, 2010.

(51) Int. Cl.
*A63H 3/00* (2006.01)
*A63H 3/02* (2006.01)

(52) U.S. Cl.
USPC ..... 446/72; 446/369

(58) Field of Classification Search
USPC ..... 446/72, 369; 5/490, 636
See application file for complete search history.

(56) References Cited

U.S. PATENT DOCUMENTS 1,285,421 A 11/1918 Seidler
4,763,369 A * 8/1988 Spector ..... 5/640

(Continued)

FOREIGN PATENT DOCUMENTS

KR 20-0306527 Y1 * 3/2003

OTHER PUBLICATIONS

PCT/US2011/058613, PCT/ISA/237, Written Opinion, Jun. 12, 2012, Korean Intellectual Property Office.

(Continued)

*Primary Examiner* — Gene Kim
*Assistant Examiner* — Alyssa Hylinski
(74) *Attorney, Agent, or Firm* — Procopio Cory Hargreaves & Savitch LLP

(57) ABSTRACT

A convertible slip cover for a convertible stuffed animal and pillow toy is quickly and easily removable and interchangeable, the convertible slip cover is much easier to wash and dry then the convertible stuffed animal and pillow, the convertible slip cover can be donned on and is convertible with the convertible stuffed animal toy in both the pillow configuration and the stuffed animal configuration, and the convertible slip cover allows for the arching of the toy in the animal configuration so that the toy still has an animal body appearance.

15 Claims, 12 Drawing Sheets

(56) References Cited

U.S. PATENT DOCUMENTS

| | | | | | |
|---|---|---|---|---|---|
| 4,768,247 | A | | 9/1988 | Beier | |
| 4,889,512 | A | | 12/1989 | Burnett et al. | |
| 4,959,879 | A | * | 10/1990 | Marxhausen | 5/636 |
| 5,027,457 | A | * | 7/1991 | Sweet | 5/640 |
| 5,070,558 | A | | 12/1991 | Fenley | |
| D356,948 | S | | 4/1995 | Nahatchewitz | |
| 5,421,045 | A | | 6/1995 | Bowen | |
| 5,509,157 | A | * | 4/1996 | Story | 5/490 |
| 5,515,563 | A | * | 5/1996 | Chao | 5/632 |
| 5,566,410 | A | | 10/1996 | Schaechter | |
| D413,477 | S | | 9/1999 | Chaney | |
| 6,041,458 | A | | 3/2000 | Vickers et al. | |
| 6,156,363 | A | | 12/2000 | Chen et al. | |
| D445,623 | S | * | 7/2001 | Hartner | D6/598 |
| 7,089,617 | B1 | | 8/2006 | Lauro | |
| 7,146,663 | B2 | * | 12/2006 | Brown et al. | 5/636 |
| 7,249,389 | B2 | | 7/2007 | Russell | |
| 7,614,961 | B2 | | 11/2009 | Schmutz | |
| 7,730,564 | B2 | | 6/2010 | Moore | |
| D637,437 | S | | 5/2011 | Lewis, II | |
| D644,056 | S | | 8/2011 | Shuler | |
| 2007/0017031 | A1 | | 1/2007 | Kaplan | |
| 2008/0182478 | A1 | | 7/2008 | Smoot et al. | |

OTHER PUBLICATIONS http://mypillowpets.com/about/, 2012.

International Search Report dated Jun. 12, 2012, issued for International Application No. PCT/US2011/058613.

* cited by examiner

CONVERTIBLE SLIPCOVER AND METHOD FOR CONVERTIBLE STUFFED ANIMAL AND PILLOW

CROSS-REFERENCE TO RELATED APPLICATIONS

This application claims priority to U.S. Provisional Patent Application 61/414,752 filed Nov. 17, 2010, U.S. Provisional Patent Application 61/412,737 filed Nov. 11, 2010, and U.S. Provisional Patent Application 61/408,990 filed Nov. 1, 2010, and is a continuation-in-part of U.S. Design patent application Ser. No. 29/402,891 filed Sep. 28, 2011, which is a continuation-in-part of U.S. Design patent application Ser. No. 29/399,394 filed Aug. 12, 2011. All of the above applications are incorporated by reference herein.

FIELD OF THE INVENTION

The invention relates, in general, to a convertible stuffed animal and pillow toy, and, in particular, to a convertible slip cover for a convertible stuffed animal and pillow toy.

BACKGROUND

Stuffed animals are popular with children and many children have their favorite stuffed animal that the child likes to take everywhere. Consequently, the stuffed animal tends to get a lot of use, become dirty, and the exterior of the stuffed animal looses its softness.

SUMMARY OF THE INVENTION

An aspect of the invention involves a convertible slip cover for a convertible stuffed animal and pillow toy that converts from a pillow configuration (FIG. 1A) to a stuffed animal configuration (FIG. 1B). In the pillow configuration, the toy includes a substantially flat, substantially rectangular pillow that a child can sleep on and, in the stuffed animal configuration, the child can play with the toy as with any stuffed animal. To convert the toy from the pillow configuration to the stuffed animal configuration, the child folds the toy along an invisible center line/spine/longitudinal axis of the toy and fastens Velcro® brand hook fasteners on a connecting side strap, which extends from one side of the toy, to Velcro® brand loop fasteners on an opposite side of the toy. The connecting strap extends along the underside of the toy and couples the opposite sides together. In the stuffed animal configuration, in addition to holding opposite sides together, tension on the opposite sides caused by the connecting strap causes the opposite sides to arch (concave upwards) as shown in FIG. 1B, giving the toy the appearance of a four-legged animal body. In one or more implementations of the convertible slip cover, the convertible slip cover is quickly and easily removable/interchangeable with respect to the convertible stuffed animal and pillow, the convertible slip cover is much easier to wash/dry then the convertible stuffed animal and pillow, the convertible slip cover can be donned on and is convertible with the convertible stuffed animal toy in both the pillow configuration and the stuffed animal configuration, and/or the convertible slip cover allows for the arching (concave upwards) of the toy in the animal configuration so that the toy maintains an animal body appearance.

Another aspect of the invention involves a method of using a convertible slip cover with a convertible stuffed animal and pillow toy, the convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration/mode where the first side member and the second side member are folded about the invisible fold line so that the first side member and the second side member form an angle relative to each other with the invisible fold line forming the vertex of the angle, the connecting strap adapted to couple the first side to the second side along the bottom surface, the convertible slip cover having a substantially rectangular configuration and including a front end, a rear end, a first side, a second side, a top surface, a bottom surface, a neck opening, a first shoulder, a second shoulder substantially co-linear with the front end, an invisible fold line separating the convertible slip cover into a first side member and a second side member. The method includes donning the convertible slip cover onto the convertible stuffed animal and pillow toy in the pillow configuration so that the substantially rectangular pillow body and connecting strap of the convertible stuffed animal and pillow toy are disposed within the convertible slip cover, the first and second shoulders of the convertible stuffed animal and pillow toy are covered by the first and second shoulders of the convertible slip cover, and the head of the convertible stuffed animal and pillow toy extends through the neck opening of the convertible slip cover; folding the convertible stuffed animal and pillow toy and the convertible slip cover about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles; coupling the first side of the convertible slip cover and the second side of the convertible slip cover together so that the first and second sides of the convertible slip cover and the convertible stuffed animal and pillow toy are arched concave upwards and the convertible stuffed animal and pillow toy and the convertible slip cover are in a stuffed animal configuration.

One or more implementations of the aspect of the invention described immediately above include one of more of the following. The convertible stuffed animal and pillow toy includes a longitudinal length L1 and a width W1, the convertible slip cover includes a longitudinal length L2 and a width W2, and W2/L1 is 1.02-1.75, W2/W1 is 0.75-1.25, L2/L1 is 0.75-1.45; the front end of the convertible stuffed animal and pillow toy includes a neck with a width N1 and the front end of the convertible slip cover includes a neck with a width N2, and N2/N1 is 0.5-1.5; the first side of the convertible slip cover includes a side hole and the slip cover includes a fastener adjacent to the second side of the convertible slip cover and the method further includes drawing the connecting strap extending from the first side of the convertible stuffed animal and pillow toy and disposed within the convertible slip cover through the side hole of the convertible slip cover so that the connecting strap extends outside of the convertible slip cover and coupling the first side of the convertible slip cover and the second side of the convertible slip cover together includes fastening the fastener of the distal end of the connecting strap to the fastener adjacent to the second side of the convertible slip cover; the convertible slip cover includes a connecting strap extending from one of the first side and the second side, the connecting strap including a distal end with a fastener extending there from, a fastener adjacent to the side opposite the side that the connecting strap extends from, and coupling the first side of the convertible slip cover and the second side of the convertible slip cover together includes fastening the fastener of the distal end of the connecting strap of the convertible slip cover to the fastener adjacent to the side opposite the side that the connecting strap extends from; the convertible slip cover includes an open top end and the first shoulder and the second shoulder of the convertible slip cover include fastener members, and donning includes inserting the substantially rectangular pillow body through the open top end until the first shoulder and the second shoulder of the substantially rectangular pillow body are substantially aligned with the first shoulder and the second shoulder of the convertible slip cover and further including fastening the first shoulder and the second shoulder of the convertible slip cover together with the fastener members of the first shoulder and the second shoulder of the convertible slip cover so that the first and second shoulders of the convertible stuffed animal and pillow toy are covered by the first and second shoulders of the convertible slip cover, and the neck of the top end of the convertible slip cover is secured around the neck of the convertible stuffed animal and pillow toy; the top surface of the convertible slip cover includes at least one pocket that is substantially horizontally oriented in the pillow configuration and substantially vertically oriented in the stuffed animal configuration; the at least one pocket includes a pair of pockets, each including an inner end opening, the pockets being substantially co-planar with each other in the pillow configuration and substantially vertically oriented in the stuffed animal configuration with the inner end openings oriented upward; the top surface of the convertible slip cover includes a handle; the handle is attached to the top surface of the convertible slip cover along the invisible fold line; and/or the convertible stuffed animal and pillow toy includes a tail extending from the rectangular pillow and the convertible slip cover includes a tail hole, and the method further includes drawing the tail of the convertible stuffed animal through the tail hole of the convertible slip cover.

Another aspect of the invention involves a combination convertible stuffed animal and pillow toy and convertible slip cover assembly including a convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration/mode where the first side member and the second side member are folded about the invisible fold line so that the first side member and the second side member form an angle relative to each other with the invisible fold line forming the vertex of the angle, the connecting strap adapted to couple the first side to the second side along the bottom surface, a convertible slip cover having a substantially rectangular configuration and including a front end, a rear end, a first side, a second side, a top surface, a bottom surface, a neck opening, a first shoulder, a second shoulder substantially co-linear with the front end, an invisible fold line separating the convertible slip cover into a first side member and a second side member, wherein the combination convertible stuffed animal and pillow toy and convertible slip cover assembly includes a pillow configuration mode where the convertible slip cover is donned onto the convertible stuffed animal and pillow toy with the convertible stuffed animal and pillow toy in the pillow configuration so that the substantially rectangular pillow body and connecting strap of the convertible stuffed animal and pillow toy are disposed within the convertible slip cover, the first and second shoulders of the convertible stuffed animal and pillow toy are covered by the first and second shoulders of the convertible slip cover, and the head of the convertible stuffed animal and pillow toy extends through the neck opening of the convertible slip cover; and a stuffed animal configuration where the convertible stuffed animal and pillow toy and the convertible slip cover are folded about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles and the first side of the convertible slip cover and the second side of the convertible slip cover are coupled together so that the first and second sides of the convertible slip cover and the convertible stuffed animal and pillow toy are arched concave upwards and the convertible stuffed animal and pillow toy and the convertible slip cover are in a stuffed animal configuration.

One or more implementations of the aspect of the invention described immediately above include one of more of the following. The convertible stuffed animal and pillow toy includes a longitudinal length L1 and a width W1, the convertible slip cover includes a longitudinal length L2 and a width W2, and W2/L1 is 1.02-1.75, W2/W1 is 0.75-1.25, L2/L1 is 0.75-1.45; the front end of the convertible stuffed animal and pillow toy includes a neck with a width N1 and the front end of the convertible slip cover includes a neck with a width N2, and N2/N1 is 0.5-1.5; the first side of the convertible slip cover includes a side hole, the slip cover includes a fastener adjacent to the second side of the convertible slip cover, the connecting strap extends outside of the convertible slip cover and couples the first side of the convertible slip cover and the second side of the convertible slip cover together via the fastener of the distal end of the connecting strap fastened to the fastener adjacent to the second side of the convertible slip cover; the convertible slip cover includes a connecting strap extending from one of the first side and the second side, the connecting strap including a distal end with a fastener extending there from, a fastener adjacent to the side opposite the side that the connecting strap extends from, and coupling the first side of the convertible slip cover and the second side of the convertible slip cover together includes fastening the fastener of the distal end of the connecting strap of the convertible slip cover to the fastener adjacent to the side opposite the side that the connecting strap extends from; the convertible slip cover includes an open top end and the first shoulder and the second shoulder of the convertible slip cover include fastener members that are fastened together so that the first and second shoulders of the convertible stuffed animal and pillow toy are covered by the first and second shoulders of the convertible slip cover, and the neck of the top end of the convertible slip cover is secured around the neck of the convertible stuffed animal and pillow toy; the top surface of the convertible slip cover includes at least one pocket that is substantially horizontally oriented in the pillow configuration and substantially vertically oriented in the stuffed animal configuration; the at least one pocket includes a pair of pockets, each including an inner end opening, the pockets being substantially co-planar with each other in the pillow configuration and substantially vertically oriented in the stuffed animal configuration with the inner end openings oriented upward; the top surface of the convertible slip cover includes a handle; the handle is attached to the top surface of the convertible slip cover along the invisible fold line; and/or the convertible stuffed animal and pillow toy includes a tail extending from the rectangular pillow and the convertible slip cover includes a tail hole that receives the tail of the convertible stuffed animal there through.

An additional aspect of the invention involves a method of using a convertible slip cover with a convertible stuffed animal and pillow toy, the convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration/mode where the first side member and the second side member are folded about the invisible fold line so that the first side member and the second side member form an angle relative to each other with the invisible fold line forming the vertex of the angle, the connecting strap adapted to couple the first side to the second side along the bottom surface, the convertible slip cover having a substantially rectangular configuration and including a front end, a rear end, a first side, a second side, a top surface, a bottom surface, a neck opening, a first shoulder, a second shoulder substantially co-linear with the front end, an invisible fold line separating the convertible slip cover into a first side member and a second side member. The method includes, in a pillow configuration mode, inserting the convertible stuffed animal and pillow toy in the pillow configuration into the convertible slip cover so that the substantially rectangular pillow body and connecting strap of the convertible stuffed animal and pillow toy are disposed within the convertible slip cover, the first and second shoulders of the convertible stuffed animal and pillow toy are covered by the first and second shoulders of the convertible slip cover, and the head of the convertible stuffed animal and pillow toy extends through the neck opening of the convertible slip cover; in a stuffed animal configuration mode, folding the convertible stuffed animal and pillow toy and the convertible slip cover, about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles; and coupling the first side of the convertible slip cover and the second side of the convertible slip cover together so that the first and second sides of the convertible slip cover and the convertible stuffed animal and pillow toy are arched concave upwards and the convertible stuffed animal and pillow toy and the convertible slip cover are in a stuffed animal configuration.

One or more implementations of the aspect of the invention described immediately above include one of more of the following. The convertible stuffed animal and pillow toy includes a longitudinal length L1 and a width W1, the convertible slip cover includes a longitudinal length L2 and a width W2, and W2/L1 is 1.02-1.75, W2/W1 is 0.75-1.25, L2/L1 is 0.75-1.45; the front end of the convertible stuffed animal and pillow toy includes a neck with a width N1 and the front end of the convertible slip cover includes a neck with a width N2, and N2/N1 is 0.5-1.5; the first side of the convertible slip cover includes a side hole and the slip cover includes a fastener adjacent to the second side of the convertible slip cover and the method further includes drawing the connecting strap extending from the first side of the convertible stuffed animal and pillow toy and disposed within the convertible slip cover through the side hole of the convertible slip cover, so that the connecting strap extends outside of the convertible slip cover and coupling the first side of the convertible slip cover and the second side of the convertible slip cover together includes fastening the fastener of the distal end of the connecting strap to the fastener adjacent to the second side of the convertible slip cover; the convertible slip cover includes a connecting strap extending from one of the first side and the second side, the connecting strap including a distal end with a fastener extending there from, a fastener adjacent to the side opposite the side that the connecting strap extends from, and coupling the first side of the convertible slip cover and the second side of the convertible slip cover together includes fastening the fastener of the distal end of the connecting strap of the convertible slip cover to the fastener adjacent to the side opposite the side that the connecting strap extends from; the convertible slip cover includes an open top end and the first shoulder and the second shoulder of the convertible slip cover include fastener members, and inserting includes inserting the substantially rectangular pillow body through the open top end until the first shoulder and the second shoulder of the substantially rectangular pillow body are substantially aligned with the first shoulder and the second shoulder of the convertible slip cover and further including fastening the first shoulder and the second shoulder of the convertible slip cover together with the fastener members of the first shoulder and the second shoulder of the convertible slip cover so that the first and second shoulders of the convertible stuffed animal and pillow toy are covered by the first and second shoulders of the convertible slip cover, and the neck of the top end of the convertible slip cover is secured around the neck of the convertible stuffed animal and pillow toy; the top surface of the convertible slip cover includes at least one pocket that is substantially horizontally oriented in the pillow configuration and substantially vertically oriented in the stuffed animal configuration; the at least one pocket includes a pair of pockets, each including an inner end opening, the pockets being substantially co-planar with each other in the pillow configuration and substantially vertically oriented in the stuffed animal configuration with the inner end openings oriented upward; the top surface of the convertible slip cover includes a handle; the handle is attached to the top surface of the convertible slip cover along the invisible fold line; the convertible stuffed animal and pillow toy includes a tail extending from the rectangular pillow and the convertible slip cover includes a tail hole, and the method further includes drawing the tail of the convertible stuffed animal through the tail hole of the convertible slip cover.

A still further aspect of the invention involves a convertible slip cover for a convertible stuffed animal and pillow toy, the convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration/mode where the first side member and the second side member are folded about the invisible fold line so that the first side member and the second side member form an angle relative to each other with the invisible fold line forming the vertex of the angle, the connecting strap adapted to couple the first side to the second side along the bottom surface. The convertible slip cover includes a substantially rectangular body including a front end, a rear end, a first side, a second side, a top surface, a bottom surface, a neck opening, a first shoulder, a second shoulder substantially co-linear with the front end, an invisible fold line separating the convertible slip cover into a first side member and a second side member, and the convertible slip cover convertible between a pillow configuration mode where the stuffed animal and pillow toy in the pillow configuration is disposed within the convertible slip cover whereby the first and second shoulders of the convertible stuffed animal and pillow toy are covered by the first and second shoulders of the convertible slip cover, and the head of the convertible stuffed animal and pillow toy extends through the neck opening of the convertible slip cover, and a stuffed animal configuration mode where the convertible stuffed animal and pillow toy and the convertible slip cover are folded about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles, and the first side of the convertible slip cover and the second side of the convertible slip cover are coupled together so that the first and second sides of the convertible slip cover and the convertible stuffed animal and pillow toy are arched concave upwards and the convertible stuffed animal and pillow toy and the convertible slip cover are in a stuffed animal configuration.

One or more implementations of the aspect of the invention described immediately above include one of more of the following. The convertible stuffed animal and pillow toy includes a longitudinal length L1 and a width W1, the convertible slip cover includes a longitudinal length L2 and a width W2, and W2/W1 is 1.02-1.75, W2/W1 is 0.75-1.25, L2/L1 is 0.75-1.45; the front end of the convertible stuffed animal and pillow toy includes a neck with a width N1 and the front end of the convertible slip cover includes a neck with a width N2, and N2/N1 is 0.5-1.5; the first side of the convertible slip cover includes a side hole, the slip cover includes a fastener adjacent to the second side of the convertible slip cover, the connecting strap extends outside of the convertible slip cover and, in the stuffed animal configuration mode, couples the first side of the convertible slip cover and the second side of the convertible slip cover together via the fastener of the distal end of the connecting strap fastened to the fastener adjacent to the second side of the convertible slip cover; the convertible slip cover includes a connecting strap extending from one of the first side and the second side, the connecting strap including a distal end with a fastener extending there from, a fastener adjacent to the side opposite the side that the connecting strap extends from, and, in the stuffed animal configuration mode, the first side of the convertible slip cover and the second side of the convertible slip cover are coupled together via the fastener of the distal end of the connecting strap of the convertible slip cover fastened to the fastener adjacent to the side opposite the side that the connecting strap extends from; the convertible slip cover includes an open top end and the first shoulder and the second shoulder of the convertible slip cover include fastener members that are fastened together so that, in the stuffed animal configuration mode, the first and second shoulders of the convertible stuffed animal and pillow toy are covered by the first and second shoulders of the convertible slip cover, and the neck of the top end of the convertible slip cover is secured around the neck of the convertible stuffed animal and pillow toy; the top surface of the convertible slip cover includes at least one pocket that is substantially horizontally oriented in the pillow configuration and substantially vertically oriented in the stuffed animal configuration; the at least one pocket includes a pair of pockets, each including an inner end opening, the pockets being substantially co-planar with each other in the pillow configuration and substantially vertically oriented in the stuffed animal configuration with the inner end openings oriented upward; the top surface of the convertible slip cover includes a handle; the handle is attached to the top surface of the convertible slip cover along the invisible fold line; and/or the convertible slip cover includes a tail hole adapted to receive the tail of the convertible stuffed animal there through.

An additional aspect of the invention involves a method of using a convertible slip cover with a convertible stuffed animal and pillow toy, the convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration mode where the first side member and the second side member are folded about the invisible fold line so that the first side member and the second side member form an angle relative to each other with the invisible fold line forming the vertex of the angle, the connecting strap adapted to couple the first side to the second side along the bottom surface, the convertible slip cover having a substantially rectangular configuration and including a front end, a rear end, a first side, a second side, an exterior surface, an interior surface, a front end opening, a top member, a bottom member, and a zipper detachably connecting the top member and the bottom member along at least the first side. The method includes donning the convertible slip cover onto the convertible stuffed animal and pillow toy in the pillow configuration so that the substantially rectangular pillow body and connecting strap of the convertible stuffed animal and pillow toy are disposed within the convertible slip cover, and the head of the convertible stuffed animal and pillow toy extends through the front end opening of the convertible slip cover; removing the convertible stuffed animal and pillow toy from the convertible slip cover; reversing the convertible slip cover so that the exterior surface becomes the interior surface and the interior surface becomes the exterior surface by unzipping the zipper, at least partially separating the top member and the bottom member along at least the first side, reversing the exterior surface and the interior surface, and zipping the zipper so that the top member and the bottom member are joined together; and donning the reversed convertible slip cover onto the convertible stuffed animal and pillow toy in the pillow configuration so that the substantially rectangular pillow body and connecting strap of the convertible stuffed animal and pillow toy are disposed within the reversed convertible slip cover, and the head of the convertible stuffed animal and pillow toy extends through the front end opening of the convertible slip cover.

One or more implementations of the aspect of the invention described immediately above include one or more of the following: the top member and bottom member include multiple panels separated by stitching; the top member and bottom member define respective substantially parallel planes (when convertible slip cover is not donned on the pillow toy), the top member and bottom member are detachably connected to each other via zipper along rear end and first side; the top member and bottom member are stuffed with a stuffing; and/or the top member and bottom member include a thickness T and length L3 and L3/T is 10-30.

Another aspect of the invention involves a combination convertible slip cover with convertible stuffed animal and pillow toy assembly. The combination convertible slip cover with convertible stuffed animal and pillow toy assembly includes a convertible stuffed animal and pillow toy including a substantially rectangular pillow body with a front end, a rear end, a first side, a second side, a top surface, a bottom surface, a head extending from the front end, a first shoulder, a second shoulder substantially co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are substantially co-planar, and a stuffed animal configuration mode where the first side member and the second side member are folded about the invisible fold line so that the first side member and the second side member form an angle relative to each other with the invisible fold line forming the vertex of the angle, the connecting strap adapted to couple the first side to the second side along the bottom surface; and a convertible slip cover having a substantially rectangular configuration and including a front end, a rear end, a first side, a second side, an exterior surface, an interior surface, a front end opening, a top member, a bottom member, and a zipper detachably connecting the top member and the bottom member along at least the first side whereby the zipper is unzipped to separate the top member and the bottom member along at least the first side to reverse the convertible slip cover and zipped to zip the top member and the bottom member together so that the exterior surface becomes the interior surface and the interior surface becomes the exterior surface.

One or more implementations of the aspect of the invention described immediately above include one or more of the following: the top member and bottom member include multiple panels separated by stitching; the top member and bottom member define respective substantially parallel planes (when convertible slip cover is not donned on the pillow toy), the top member and bottom member are detachably connected to each other via zipper along rear end and first side; the top member and bottom member are stuffed with a stuffing; and/or the top member and bottom member include a thickness T and length L3 and L3/T is 10-30.

A further aspect of the invention involves a method of folding a convertible slip cover into a folded convertible slip cover assembly, the convertible slip cover including a substantially rectangular configuration, a front end, a rear end, a first side, a second side, a top surface, a bottom surface, a handle on the top surface, and a plurality of invisible fold lines dividing the cover into a plurality of sections, the method includes folding the plurality of sections of the convertible slip cover along the plurality of invisible fold lines 180 degrees away from the handle and towards the bottom surface so as to create substantially parallel overlapping folds; and threading a band around the substantially parallel overlapping folds so that the band is disposed between the handle and the top surface and holds the folded convertible slip cover assembly together.

One or more implementations of the aspect of the invention described immediately above include one or more of the following: the plurality of fold lines divide the slip cover into longitudinally elongated thirds and laterally elongated thirds; the laterally elongated thirds have a top third and a bottom third with the same length and a center third with a length twice the length of the top third and the bottom third; and/or the longitudinally elongated thirds have substantially the same width.

A still further aspect of the invention involves a folded convertible slip cover assembly including a convertible slip cover with a substantially rectangular configuration, a front end, a rear end, a first side, a second side, a top surface, a bottom surface, a handle on the top surface, and a plurality of invisible fold lines dividing the cover into a plurality of sections, the plurality of sections foldable along the plurality of invisible fold lines 180 degrees away from the handle and towards the bottom surface so as to create substantially parallel overlapping folds; and a band threaded around the substantially parallel overlapping folds and between the handle and the top surface, hold the folded convertible slip cover assembly together.

One or more implementations of the aspect of the invention described immediately above include one or more of the following: the plurality of fold lines divide the slip cover into longitudinally elongated thirds and laterally elongated thirds; the laterally elongated thirds have a top third and a bottom third with the same length and a center third with a length twice the length of the top third and the bottom third; and/or the longitudinally elongated thirds have substantially the same width.

An additional aspect of the invention involves a method of using a slip cover with a stuffed animal pillow toy convertible between a generally flat, pillow configuration for use as a pillow and a folded, stuffed animal configuration in which first and second side portions of the toy are folded towards one another about a central longitudinal axis of the toy extending between opposite ends of the toy and secured together in the folded configuration. The method includes inserting a stuffed animal pillow toy in a generally flat, pillow configuration through an end opening of a slip cover so that a substantially rectangular pillow body and connecting strap of the stuffed animal pillow toy are disposed within the slip cover and a head of the convertible stuffed animal pillow toy extends through the end opening of the slip cover, forming a covered stuffed animal pillow toy; folding the covered stuffed animal pillow toy about a central longitudinal axis into a folded, stuffed animal configuration in which first and second opposite side portions of the covered stuffed animal pillow toy form an angle relative to each other with the central longitudinal axis at the vertex; coupling the first side portion to the second side portion to hold the covered stuffed animal pillow toy in the folded stuffed animal configuration; and releasing the first side portion from the second side portion and unfolding the covered stuffed animal toy into a generally flat, pillow configuration in order to use the covered toy as a pillow.

One or more implementations of the aspect of the invention described immediately above include one or more of the following: drawing the connecting strap of the stuffed animal pillow toy through a side hole in the slip cover prior to folding the covered stuffed animal pillow toy into the folded, stuffed animal configuration, the strap extending from the first side portion of the covered stuffed animal pillow toy in the folded configuration, and the step of coupling the first side portion to the second side portion comprising securing a fastener end of the strap to a fastener located on the slip cover in the second side portion of the folded, covered stuffed animal pillow toy; the stuffed animal pillow toy includes a longitudinal length L1 and a width W1, the slip cover includes a longitudinal length L2 and a width W2, and W2/L1 is 1.02-1.75, W2/W1 is 0.75-1.25, and L2/L1 is 0.75-1.45; the stuffed animal pillow toy includes a front end having a neck with a width N1 and the slip cover includes a front end having a neck with a width N2, and N2/N1 is 0.5-1.5; the slip cover includes a connecting strap extending from one of the first side portion and the second side portion, the connecting strap including a distal end with a fastener extending there from, a fastener adjacent to the side portion opposite the side portion that the connecting strap extends from, and coupling the first side portion of the slip cover and the second side portion of the slip cover together includes fastening the fastener of the distal end of the connecting strap of the slip cover to the fastener adjacent to the side portion opposite the side portion that the connecting strap extends from; the substantially rectangular pillow body includes first and second shoulders, the slip cover includes an open top end, a first shoulder, and a second shoulder, the shoulders including fastener members, and donning includes inserting the substantially rectangular pillow body through the open top end until the first shoulder and the second shoulder of the substantially rectangular pillow body are substantially aligned with the first shoulder and the second shoulder of the slip cover and further including fastening the first shoulder and the second shoulder of the slip cover together with the fastener members of the first shoulder and the second shoulder of the slip cover so that the first and second shoulders of the stuffed animal pillow toy are covered by the first and second shoulders of the slip cover, and the neck of the top end of the slip cover is secured around the neck of the stuffed animal pillow toy; the slip cover includes a top surface with at least one pocket that is substantially horizontally oriented in the pillow configuration and substantially vertically oriented in the stuffed animal configuration; the at least one pocket includes a pair of pockets, each including an inner end opening, the pockets being substantially co-planar with each other in the pillow configuration and substantially vertically oriented in the stuffed animal configuration with the inner end openings oriented upward; the slip cover includes a top surface with a handle; the handle is attached to the top surface of the slip cover along the longitudinal axis; and/or the stuffed animal pillow toy includes a tail and the slip cover includes a tail hole, and the method further includes drawing the tail of the convertible stuffed animal through the tail hole of the slip cover.

DETAILED DESCRIPTION OF PREFERRED EMBODIMENTS OF THE INVENTION

With reference to FIG. 1A to FIG. 8, an embodiment of a convertible slip cover 50 and method for a convertible stuffed animal and pillow toy 90 will be described. The convertible stuffed animal and pillow toy 90 is convertible between a pillow configuration/mode 92 (FIG. 1A) and a stuffed animal configuration/mode 94 (FIG. 1B).

Figure 1A:
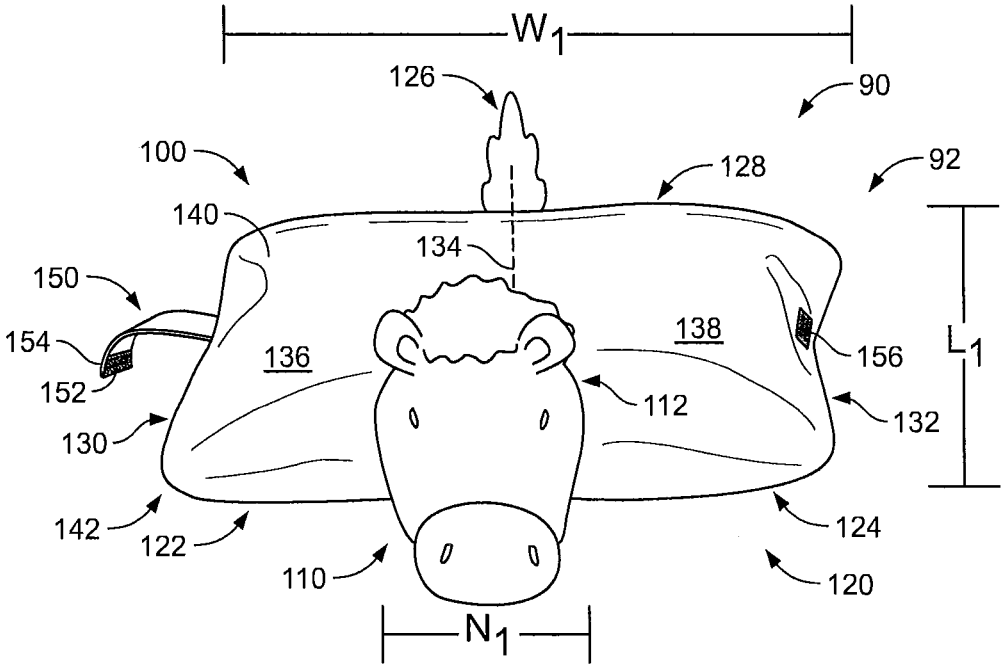
FIG. 1A is a perspective view of an embodiment of a convertible stuffed animal and pillow toy in a pillow configuration.

In the pillow configuration 92 shown in FIG. 1A, the convertible stuffed animal and pillow toy 90 includes a substantially flat, substantially rectangular pillow body 100 and a head 110 extending laterally outward via neck 112 from a front/top end 120 of the pillow body 100. The top end 120 includes substantially co-linear first shoulder 122 and second shoulder 124 separated by neck 112. The neck 112 includes a width N1 of about 15 cm in one embodiment and about 12 cm in another embodiment. In one or more embodiments, the convertible stuffed animal and pillow toy 90 includes a tail 126 extending from a center of a bottom/rear end 128. The pillow body 100 includes opposite first side/side portion 130 and second side/side portion 132. In alternative embodiments, the pillow body 100 is not rectangular. For example, but not by way of limitation, the pillow body 100 is spherical, elliptical, oval, round, circular, curvilinear, and/or rectilinear. In further embodiments, the pillow body 100 (rectangular or non-rectangular) does not include head 110, neck 112, and/or tail 126.

The lengths of the opposite sides 130, 132 (i.e., longitudinal length L1 of the convertible stuffed animal and pillow toy 90) are the same and are about 34 cm in one embodiment and about 21 cm in another embodiment. The lengths of the ends 120, 122 (i.e., width W1 of the convertible stuffed animal and pillow toy 90) are the same and are about 46 cm in one embodiment and about 28 cm in another embodiment. The pillow body 100 includes an invisible fold line/spine/longitudinal axis 134 that separates the pillow body 100 into substantially coplanar first side member 136 and second side member 138. The pillow body 100 includes a top surface 140 and a bottom surface 142 are made of super-soft materials (e.g., plush material). Extending from a center of the first side 130 is a connecting strap 150. The connecting strap 150 includes a Velcro® brand hook fastener 152 at a distal end 154. A Velcro® brand loop fastener 156 is disposed adjacent to the opposite second side 132, on a center of the top surface 140. In the pillow configuration 92, the child may put the convertible stuffed animal and pillow toy 90 in a desired orientation so that either surface 140, 142 is facing up and the child may rest one's head on the pillow body 100.

Figure 1B:
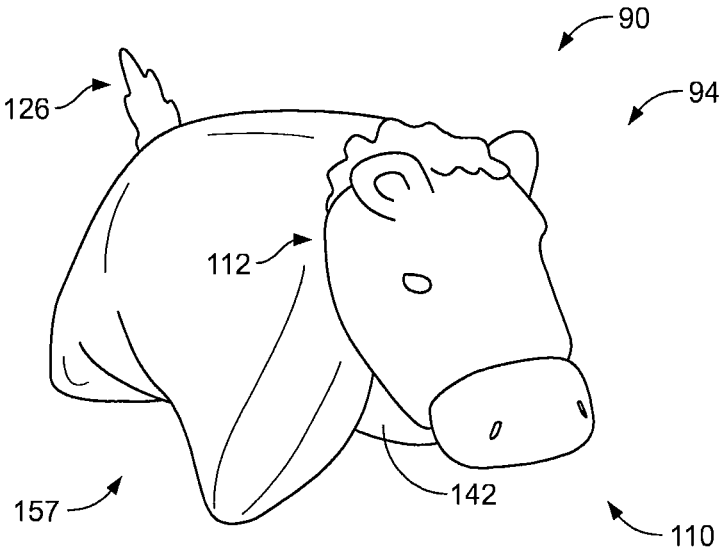
FIG. 1B is a perspective view of an embodiment of a convertible stuffed animal and pillow toy in a stuffed animal configuration.

In the stuffed animal configuration 94 shown in FIG. 1B, the convertible stuffed animal and pillow toy 90 is folded along invisible fold line/spine/longitudinal axis 134 and the opposite sides 130, 132 are coupled adjacent to each other via fasteners 152, 156 with the connecting strap 150. In the stuffed animal configuration 94, the first side member 136 and second side member 138 form an angle with each other (i.e., no longer substantially coplanar) with the invisible fold line/spine/longitudinal axis 134 forming the vertex of the angle. In addition to holding opposite sides 130, 132 together, tension on the opposite sides 130, 132 caused by the connecting strap 150 causes the opposite sides 130, 132 to form concave upward arches 157 as shown in FIG. 1B, giving the toy 90 the appearance of a four-legged animal body. In this configuration 94, the child can play with the toy 90 as with any stuffed animal.

Figure 3A:
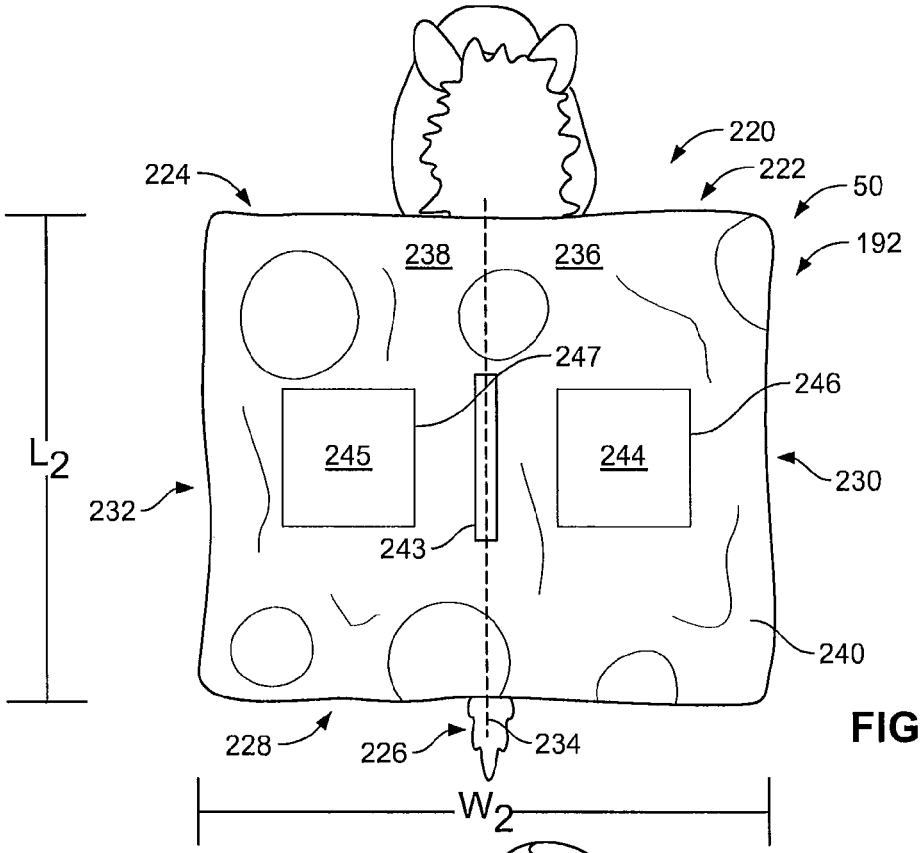
FIG. 3A is front elevational view of an embodiment a convertible slip cover shown donned on the convertible stuffed animal and pillow toy.
Figure 3B:
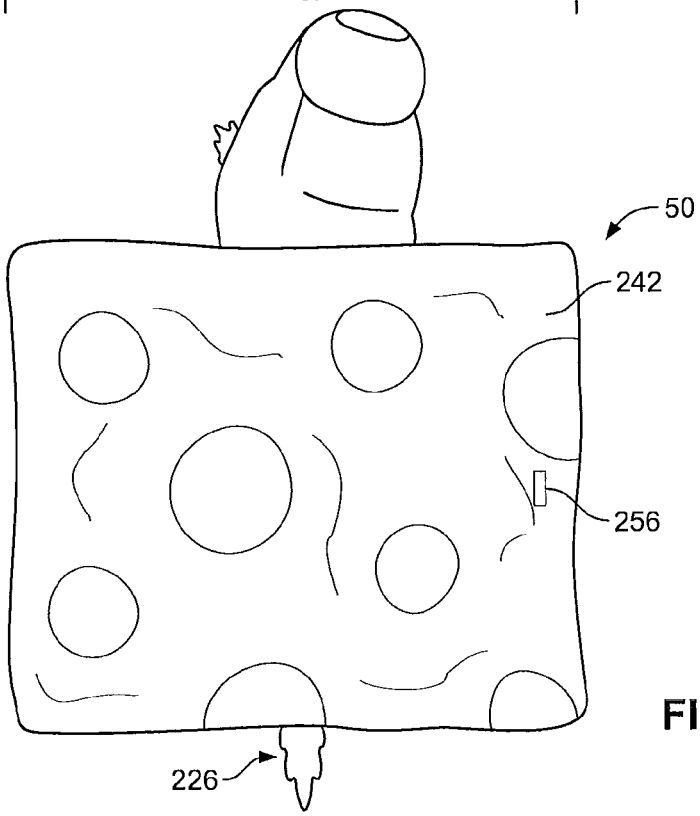
FIG. 3B is rear elevational view of the convertible slip cover and toy.
Figure 3C:
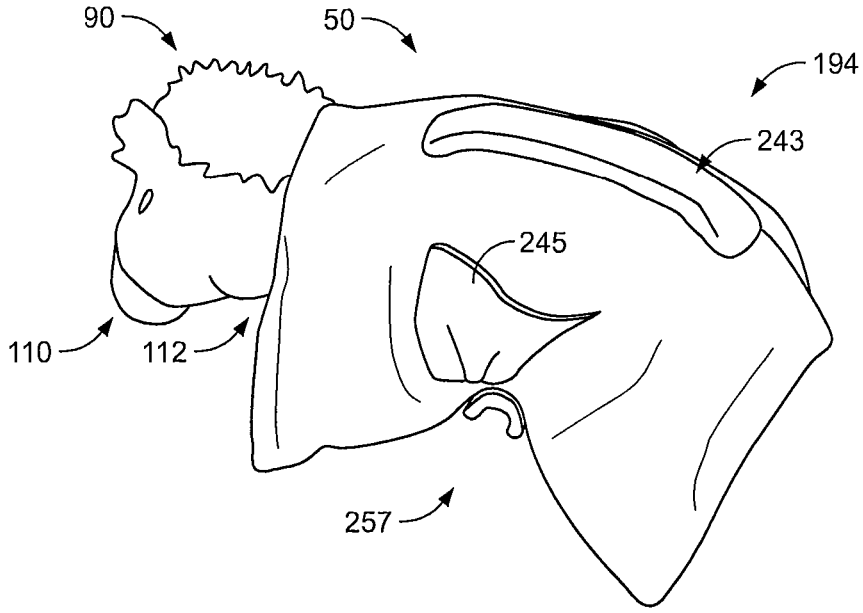
FIG. 3C is a perspective view of the convertible slip cover and toy.
Figure 3D:
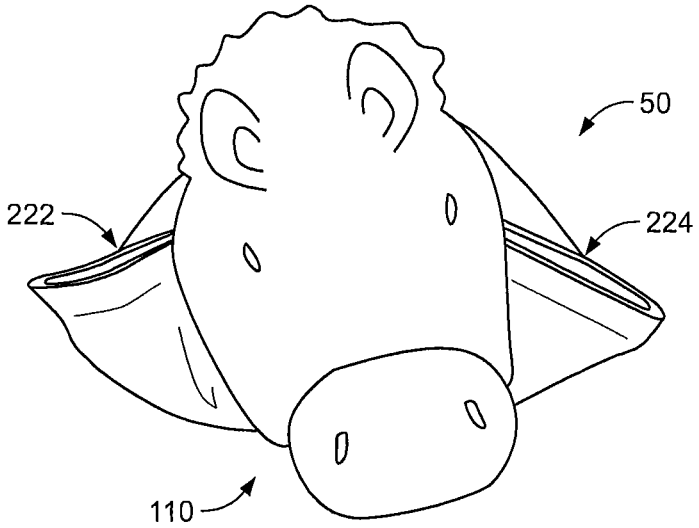
FIG. 3D is a top plan view of the convertible slip cover and toy.
Figure 3E:
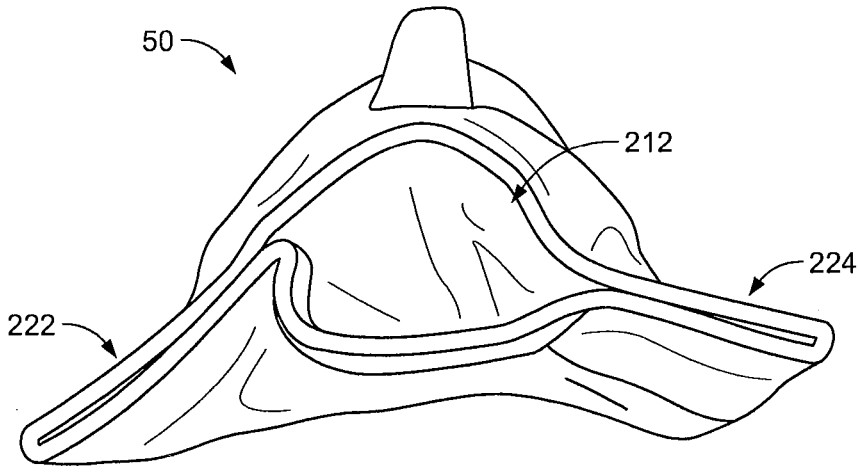
FIG. 3E is a top plan view of the convertible slip cover.

The convertible slip cover 50 and method for a convertible stuffed animal and pillow toy 90 will now be described. Similar to the convertible stuffed animal and pillow toy 90, the convertible slip cover 50 is convertible between a pillow configuration/mode 192 (FIG. 3A) and a stuffed animal configuration/mode 194 (FIG. 3C).

Figure 2A:
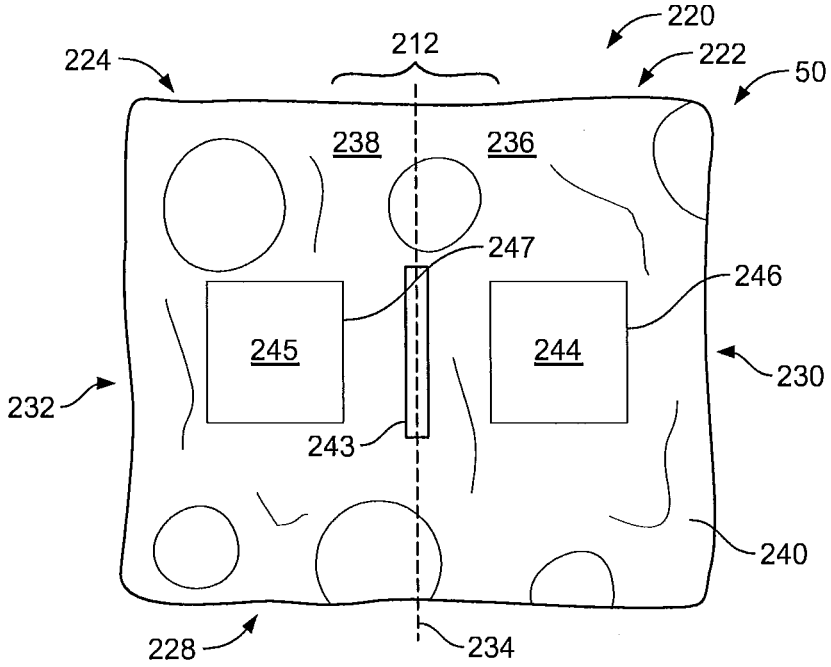
FIG. 2A is a front elevational view of an embodiment a convertible slip cover for the convertible stuffed animal and pillow toy.
Figure 2B:
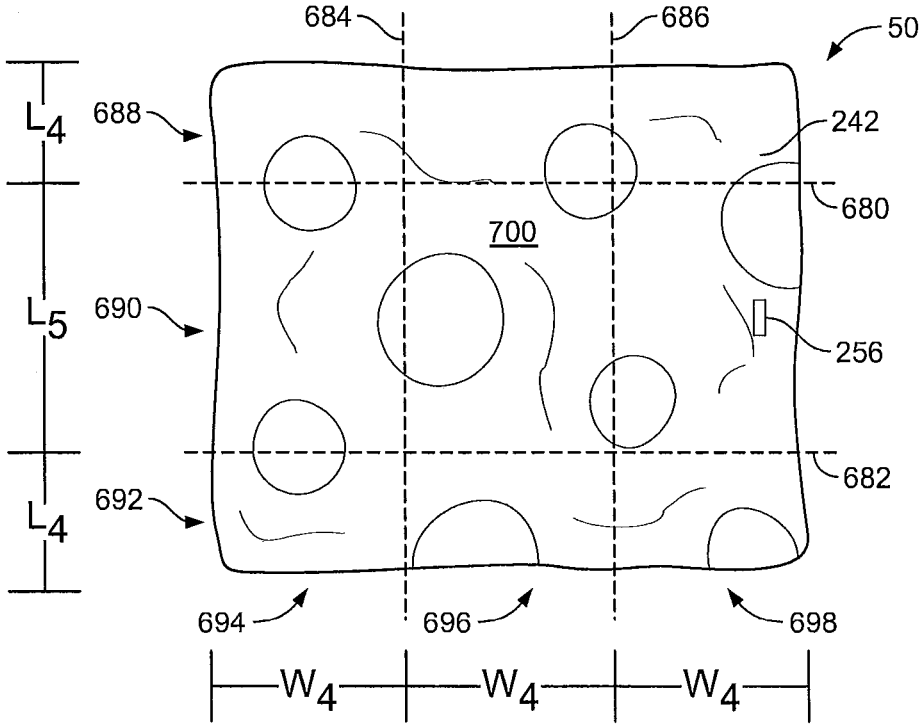
FIG. 2B is a rear elevational view of the convertible slip cover.
Figure 2C:
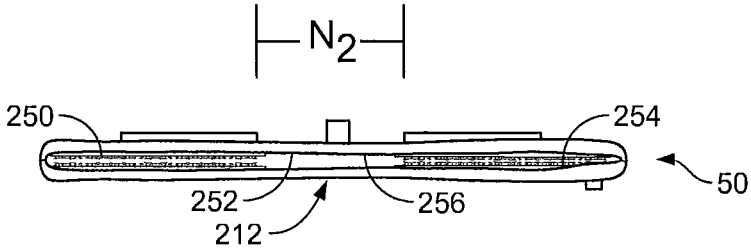
FIG. 2C is a top plan view of the convertible slip cover.
Figure 2D:
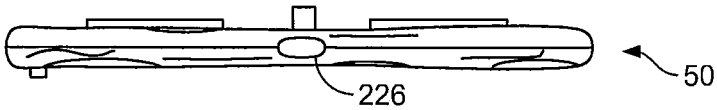
FIG. 2D is a bottom plan view of the convertible slip cover.
Figure 2E:
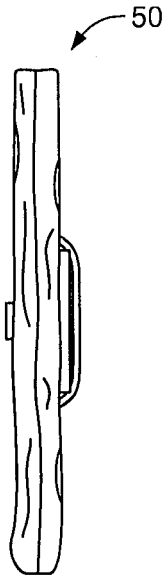
FIG. 2E is a left side-elevational view of the convertible slip cover.

In the pillow configuration/mode 192, the convertible slip cover 50 has a substantially rectangular configuration. When not donned on the toy, the convertible slip cover 50 is substantially flat as shown in FIGS. 2C-2F. The convertible slip cover 50 includes a neck 212 along a front/top end 220. In the embodiment shown, substantially linear top end 220 includes substantially co-linear first shoulder 222, neck 212, and second shoulder 224, with the neck 212 separating the first and second shoulders 222, 224. The neck 212 includes a width N2 of about 15 cm in one embodiment and about 14 cm in another embodiment. The ratio of the width N2 to N1 (i.e., N2/N1) is preferably 0.5 to 1.5. In alternative embodiments, the neck 212 includes a different shape/configuration and/or is not co-linear with the first and second shoulders 222, 224. As shown in FIG. 3F, the bottom/rear end 228 includes a tail hole 226 disposed at a center of the bottom/rear end 228. The convertible slip cover 50 includes opposite first side/side portion 230 and second side/side portion 232. The lengths of the opposite sides 230, 232 (i.e., longitudinal length L2 of the convertible slip cover 50) are the same. The lengths of the ends 220, 228 (i.e., width W2 of the convertible slip cover 50) are the same. In the embodiment shown, the width W2 is longer than the length L2 with the width W2 being about 46 cm in one embodiment and being about 33 cm in another embodiment and the length L2 being 41 cm in one embodiment and about 27 cm in another embodiment. The ratio of the width W2 to L1 (i.e., W2/L1) is preferably 1.02 to 1.75. The ratio of the width W2 to W1 (i.e., W2/W1) is preferably 0.75 to 1.25. The ratio of the length L2 to L1 (i.e., L2/L1) is preferably 0.75 to 1.45. Maintaining these ratios is important for ensuring that the convertible slip cover 50 has a firm enough fit, but not too firm, on the convertible stuffed animal and pillow toy 90 so that the convertible stuffed animal and pillow toy 90 (and convertible slip cover 50) are able to freely move together in unison between the stuffed animal configuration and the pillow configuration. The convertible slipcover 50 includes an invisible fold line/spine/longitudinal axis 234 that separates the convertible slip cover 50 into substantially coplanar first side member 236 and second side member 238.

The convertible slip cover 50 includes a top surface 240 and a bottom surface 242. The top surface 240 and bottom surface 242 are preferably made of super-soft materials (e.g., super-soft polyester material(s)), which are preferably different, but may be the same. The convertible slip cover 50 includes a handle 243 for convenient and easy carrying of the convertible stuffed animal and pillow toy 90. The handle 243 is attached to the fold line/spine/longitudinal axis 234 at a center of the top surface 240 and is co-linear with the invisible fold line/spine/longitudinal axis 234. In the pillow configuration/mode 192, the child can easily and conveniently carry the toy 90 around with the handle 243.

The top surface 240 and/or the bottom surface 242 include one or more pockets. In the embodiment shown, the top surface 240 includes a pair of substantially rectangular pockets 244, 245. The first side member 236 include first pocket 244 and the second side member 238 includes second pocket 245. The pockets 244, 245 include closed outer ends 246 and inner ends with inner end openings 247. The closed outer ends 246 are adjacent to and face opposite sides 230, 232. The inner end openings 247 are adjacent to, face, and are substantially parallel with the handle 243, and face each other. The pockets 244, 245 can be used by the child to carry items around with the convertible slip cover 50. In alternative embodiments, the convertible slip cover 50 includes pocket(s) 244 different than those shown/described (e.g., different number(s) of pockets (e.g., 1, 3, 4, 5, etc.), different-sized pocket(s), different-shaped pocket(s), pocket(s) in different location(s), pocket(s) on bottom surface 242 and/or top surface 240, pocket(s) with flap(s)/cover(s), pocket(s) that are openable/closeable).

Figure 2F:
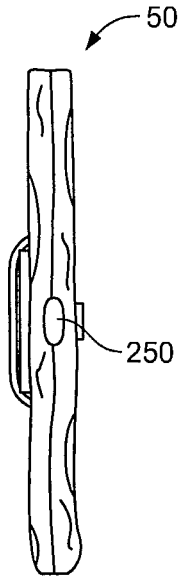
FIG. 2F is a right side-elevational view of the convertible slip cover.
Figure 3F:
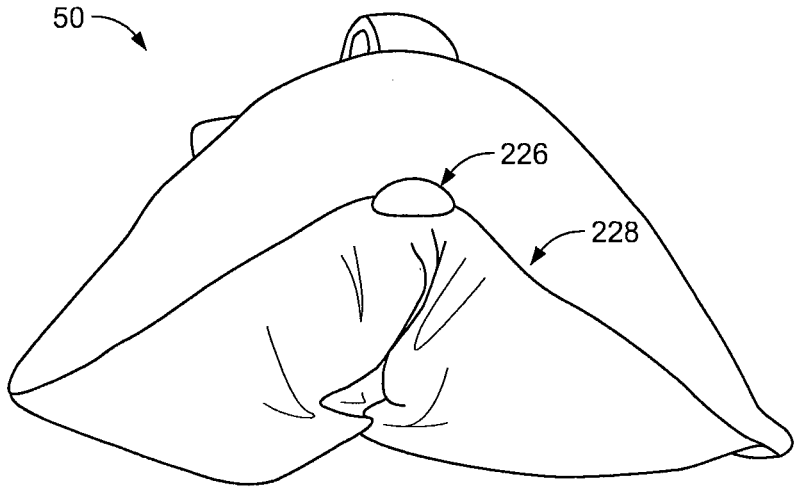
FIG. 3F is a bottom plan view of the convertible slip cover and toy.

As shown in FIG. 2F, a side strap hole 250, which accommodates the connecting strap 150 there through, is disposed at a center of the first side 230. As shown in FIG. 3B, a Velcro® brand loop fastener 256 is disposed adjacent to the opposite second side 232, on a center of the bottom surface 242.

In the pillow configuration 192, the child may put the convertible slip cover 50, which is donned on the convertible stuffed animal and pillow toy 90, and toy 90 in a desired orientation so that either surface 240, 242 is facing up and the child may rest one's head on the upward-facing surface 240, 242 with the pillow body 100 donned with the convertible slip cover 50.

In the embodiment shown, all three of the first shoulder 222, the neck 212, and the second shoulder 224 are open along the top end 220 for inserting the convertible stuffed animal and pillow toy 90 there through into the convertible slip cover 50 for donning the convertible slip cover 50 onto the toy 90. As shown in FIG. 2C, a first set of hook and loop fastener members 250 are disposed along inner surfaces 252 of the first shoulder 222 of the convertible slip cover 50 and a second set of hook and loop fastener members 254 are disposed along inner surfaces 256 of the second shoulder 224 of the convertible slip cover 50. The first and second sets of hook and loop fastener members 250, 254 allow the first shoulder(s) 222 to be detachably fastened together and the second shoulder(s) to be detachably fastened together for securing the neck 212 of the top end 220 around the neck 112 of the convertible stuffed animal and pillow toy 90 so that the head 110 extends outward from the top end 220 of the convertible slip cover 50.

In one more additional embodiments/implementations of the convertible slip cover 50, one or more of the handle, the pocket(s), and/or the tail hole are not present.

Figure 6:
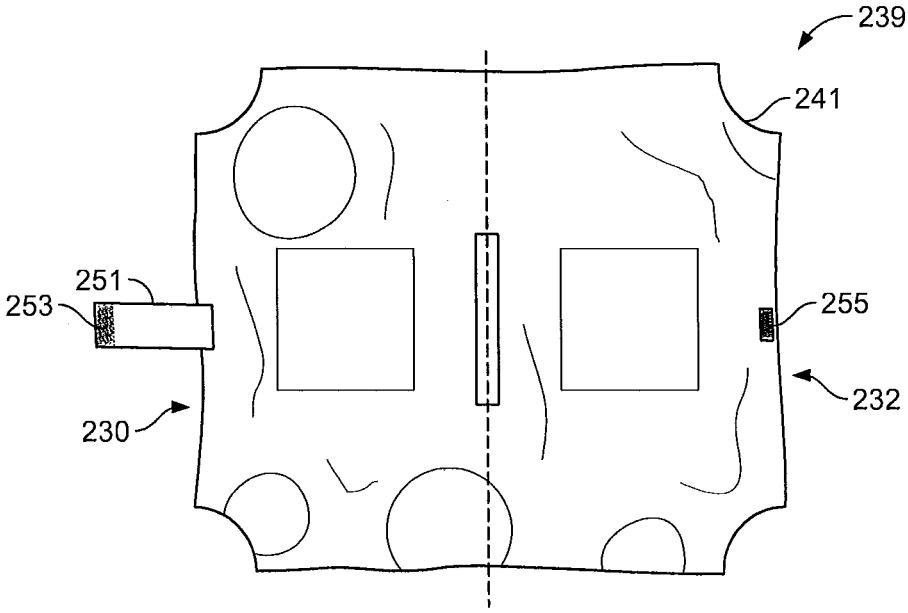
FIG. 6 is a front elevational view of another embodiment a convertible slip cover for the convertible stuffed animal and pillow toy.

With reference to FIG. 6, in an alternative embodiment of a convertible slip cover 259, side strap hole 250 is replaced with a connecting strap 251 that extends from the first side 230 and includes a Velcro® brand hook member 253 (e.g., the same as or similar to connecting strap 150) to couple the opposite sides 230, 232 together in the stuffed animal configuration/mode 192 via the strap 251, hook member 253, and Velcro® brand loop member 255 adjacent to opposite side 232.

An advantage of a convertible slip cover 50 including the side strap hole 250 over the convertible slip cover 259 including the connecting strap 251 is that with the slip cover 50, there is no side strap 251 extending/dangling from the convertible slip cover 50 when the convertible slip cover 50 is in the pillow configuration/mode 192. The connecting strap 150 of the convertible stuffed animal and pillow toy 90 can stay hidden, within the convertible slip cover 50, when the convertible slip cover 50 is in the pillow configuration/mode 192 so that the connecting strap 150 of the convertible stuffed animal and pillow toy 90 is not dangling. In one or more alternative embodiments, the convertible slip cover 259 shown in FIG. 6 does not include the strap 251, the loop member 255 is located on the bottom of the slip cover, and/or the slip cover 259 does not include corner openings 241.

In one or more additional embodiments, the convertible slip cover 50 includes one or more openings that the convertible stuffed animal and pillow toy 90 and/or the head 110 is inserted through and/or extends through when donning the convertible slip cover 50 on the convertible stuffed animal and pillow toy 90 while allowing the head 110 to extend outwardly from the top end 220 of the convertible slip cover 50. For example, but not by way of limitation, in one or more embodiments and/or implementations, the convertible slip cover 50 includes one or more openings in one or more of the neck 212, the first shoulder 222, the second shoulder 224, the top end 220, the bottom/rear end 228, the first side 230, the second side 232, the first side member 236, the second side member 238, the top surface 240, and/or the bottom surface 242. In one or more embodiments and/or implementations, the one or more openings is/are openable/closable with one or more fasteners. The one or more fasteners include, but not by way of limitation, one or more of zipper(s), hook and loop fastener(s) (e.g., Velcro® brand hook/loop fasteners, button(s), snap(s), clasp(s), latch(es), and/or other fastener(s).

As shown in FIG. 6, in another embodiment, four corners 239 of the convertible slip cover 50, which correspond to the location of the feet at the corners of the convertible stuffed animal and pillow toy 90 may be cut out (i.e., include respective holes/openings 241) to allow the feet/corners of the convertible stuffed animal and pillow toy 90 to protrude there through to give the appearance of the stuffed animal's feet extending out of an outfit. In an alternative embodiment, only the front corners 239 include the openings 241 or only the rear corners 239 include the openings 241.

Figure 3G:
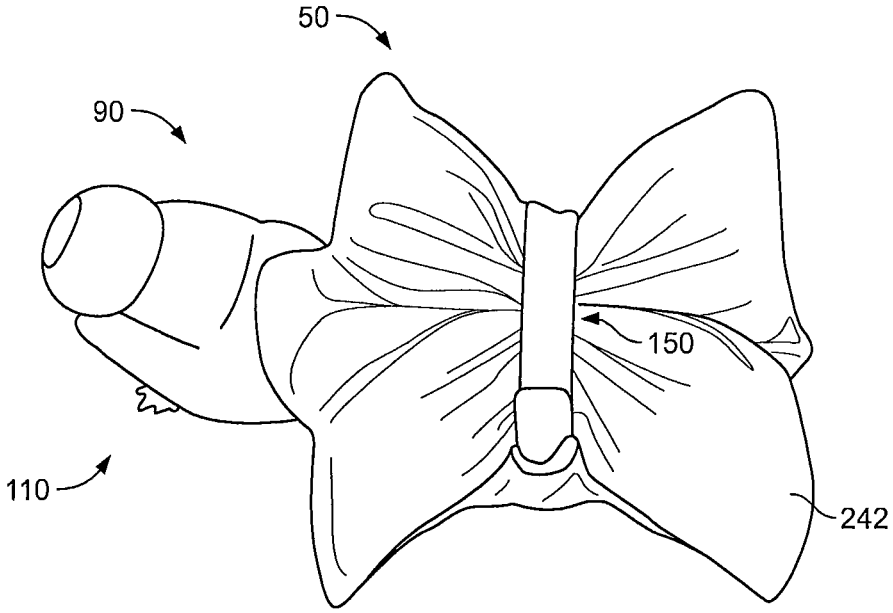
FIG. 3G is a rear elevational view of the convertible slip cover and toy.
Figure 3H:
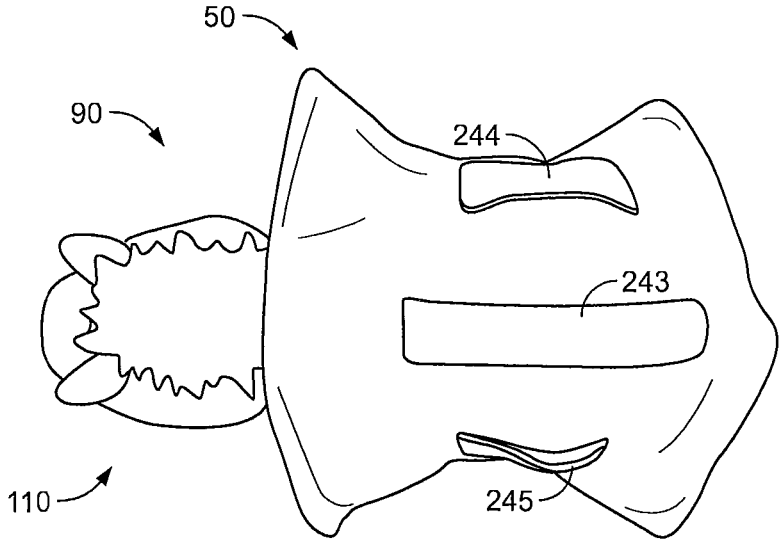
FIG. 3H is a front elevational view of the convertible slip cover and toy.

In the stuffed animal configuration/mode 194, with the convertible slip cover 50 donned on the convertible stuffed animal and pillow toy 90 (also referred to herein as "covered stuffed animal pillow toy"), both the convertible slip cover 50 and the convertible stuffed animal and pillow toy 90 are folded along invisible fold line/spine/longitudinal axis 134, 234 and the opposite sides 130, 132, 230, 232 are coupled adjacent to each other via fasteners 152, 256 with the connecting strap 150. In the stuffed animal configuration 194, the first side members 136, 236 and the second side member 138, 238 form an angle with each other (i.e., no longer substantially coplanar) with the invisible fold line(s)/spine/longitudinal axis 134, 234 forming the vertex of the angle. In addition to holding opposite sides 130, 132, 230, 232 together, tension on the opposite sides 130, 132, 230, 232 caused by the connecting strap 150 causes the opposite sides 130, 132, 230, 232 to form concave upward arches 257 as shown in FIG. 3A, giving the toy 90 the appearance of a four-legged animal body. In this configuration 194, the child can play with the toy 90 as with any stuffed animal and the child can easily and conveniently carry the toy 90 around with the handle 243. When the toy 90 is carried via the handle 243 in the stuffed animal configuration/mode 194, the opposite sides 130, 132, 230, 232 are coupled adjacent to each other, causing the formerly co-planar and inwardly facing pockets 244, 245 to now be substantially vertical extending pockets 244, 245 (with the open inner ends 247 facing upwardly) as shown in FIGS. 3A, 3G, and 3H, allowing the child to carry items around in the pocket(s) 244, 245 with the convertible slip cover 50.

Figure 3I:
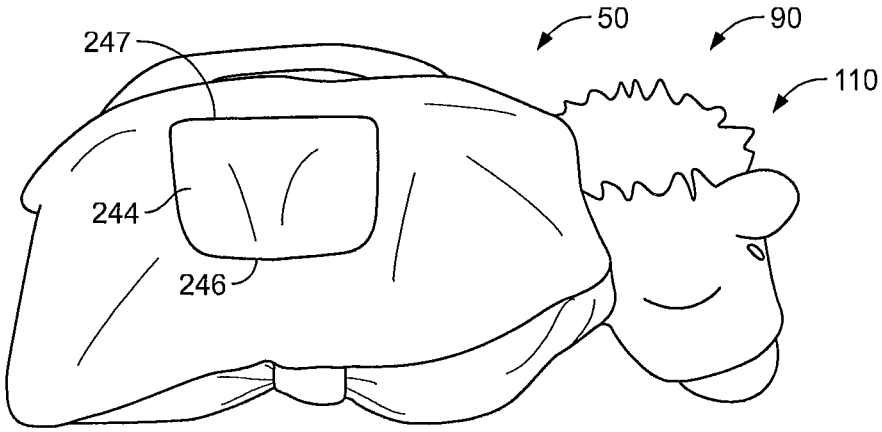
FIG. 3I is a right elevational view of the convertible slip cover and toy.
Figure 3J:
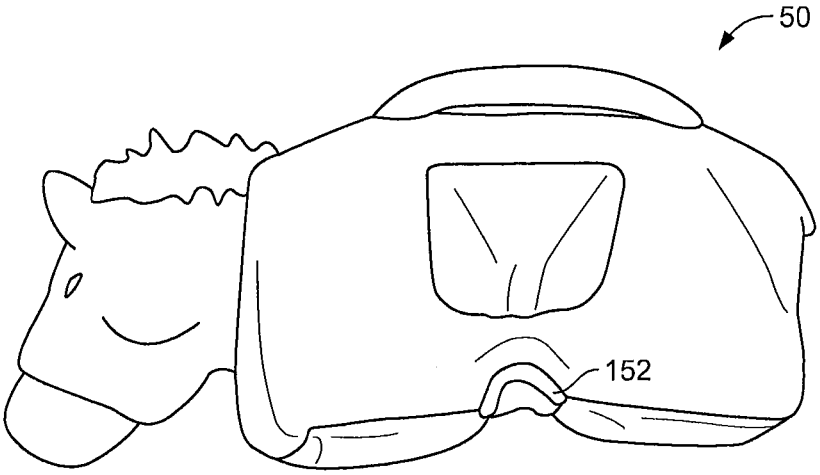
FIG. 3J is a left elevational view of the convertible slip cover and toy.
Figure 4A:
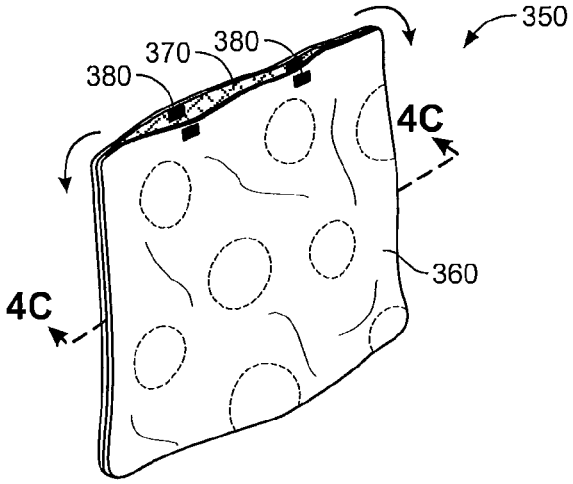
FIG. 4A is a perspective view of an embodiment a reversible convertible slip cover for the convertible stuffed animal and pillow toy.
Figure 4B:
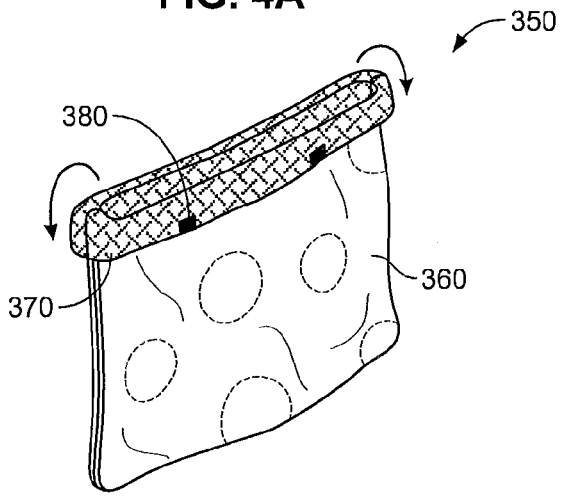
FIG. 4B is another perspective view of the reversible convertible slip cover.
Figure 4C:
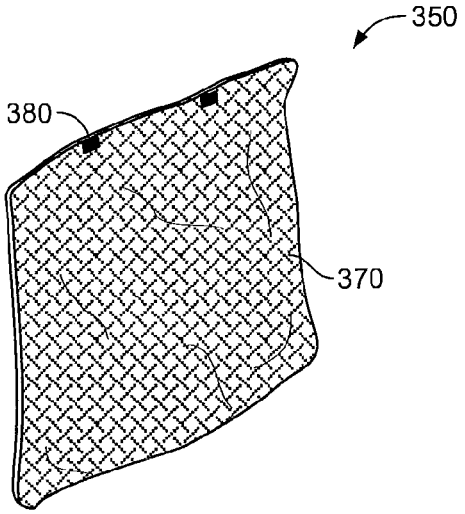
FIG. 4C is a further perspective view of the reversible convertible slip cover taken along line 4C-4C of FIG. 4A.

With reference to FIGS. 4A and 4B, another embodiment of a convertible slip cover 350 will be described. A main difference with the convertible slip cover 350 (compared to the convertible slip cover 50 shown and described with respect to FIGS. 2A-3J) is that the convertible slip cover 350 is reversible. The reversible convertible slip cover 350 includes first material layer(s)/surface(s) 360 and second material layer(s)/surface(s) 370. The convertible slip cover 350 can easily be reversed (as shown in FIGS. 4A-4C) so that either first material layer(s)/surface(s) 360 or second material layer(s)/surface(s) 370 is on the outside/externally exposed. In one or more embodiments, the first material layer(s)/surface(s) 360 are made of different materials (e.g., plush, soft, fleece, minky, etc.), the second material layer(s)/surface(s) 370 are made of different materials, the first material layer(s)/surface(s) 360 are made of the same materials, the second material layer(s)/surface(s) 370 are made of the same materials, the first and second material layer(s)/surface(s) 360, 370 are made of different materials (e.g., plush, soft, fleece, minky, etc. for first material layer(s)/surface(s) and cotton, cotton/polyester, organic cotton, hypoallergenic material, etc. for second material(s) layer/surface(s)), the first and second material layer(s)/surface(s) 360, 370 are made of the same materials, and/or the first and second material layer(s)/surface(s) 360, 370 include different patterns/indicia (e.g., first material layer(s)/surface(s) 360 coordinates with first type of convertible stuffed animal and pillow toy and second material(s)/surface(s) 370 coordinates with second type of convertible stuffed animal and pillow toy 90, handle on first material(s)/surface(s), other feature(s) on second material(s)/surface(s)).

In the embodiment shown, both material layers/surfaces 360, 370 include hook and loop fasteners 380 in the same relative locations so, regardless of whether the first or second material layer(s)/surface(s) 360, 370 is on the outside, the convertible slip cover 350 can be fastened together around the neck 112 of the convertible stuffed animal and pillow toy 90 for donning the convertible slip cover 350 on the convertible stuffed animal and pillow toy 90. The reversible convertible slip cover 350 may have any number of additional or different features such as, but not limited to, holes, hook and loop fasteners, and/or straps that allow for the convertible stuffed animal and pillow toy 90 to be closed/moved into the stuffed animal configuration with the convertible slip cover 350 donned on the convertible stuffed animal and pillow toy 90.

Figure 5:
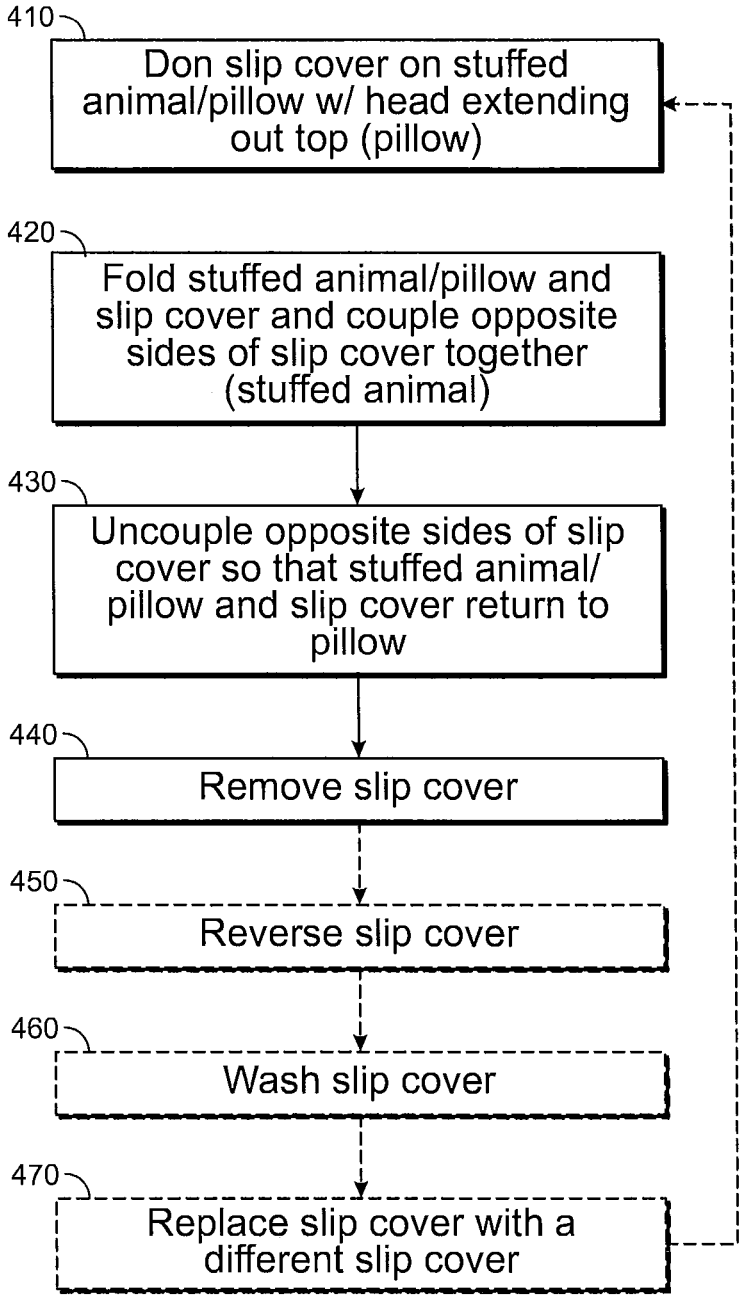
FIG. 5 is a flow chart of an exemplary method of using the reversible convertible slip cover with the convertible stuffed animal and pillow toy.

With reference to FIG. 5, a method 400 of using the convertible slip cover 50, 239, 350 with the convertible stuffed animal and pillow toy 90 will now be described. First, at step 410, the slip cover 50, 239, 350 is donned on the toy 90 by inserting the convertible stuffed animal and pillow toy 90, in a pillow configuration, into the convertible slip cover 50, 239, 350. In this configuration, the cover 50 and toy 90 become a covered stuffed animal pillow toy. The top end 220 if opened by respectively detaching the first and second sets of hook and loop fastener members 250, 254 at the first shoulder(s) 222 and the second shoulder(s) 224, opening the top end 220. The substantially rectangular pillow body 100 is inserted through the open top end 220 until the first shoulder 122 and the second shoulder 124 of the pillow body 100 are substantially aligned with the first shoulder 222 and the second shoulder 224 of the cover 50, 239, 350. The first and second sets of hook and loop fastener members 250, 254 are respectively fastened together to respectively fasten the first shoulder(s) 222 and the second shoulder(s) 224 together. This secures the neck 212 of the top end 220 around the neck 112 of the convertible stuffed animal and pillow toy 90 so that the head 110 extends outward from the top end 220 of the convertible slip cover 50. With the slip cover 50, 239, 350 in the pillow configuration/mode 192, the child may put the convertible slip cover 50, which is donned on the convertible stuffed animal and pillow toy 90, and toy 90 in a desired orientation so that either side 230, 232 is facing up and the child may rest one's head on the pillow body 100 donned with the convertible slip cover 50. The child may also conveniently and easily carry the convertible stuffed animal and pillow toy 90 donned with the slip cover 50 around using the handle 243.

Then, at optional step 420, the convertible slip cover 50 donned on the convertible stuffed animal and pillow toy 90 is put into the stuffed animal configuration/mode 194. The connecting strap 150 is threaded through side strap hole 250 so that the connecting strap extends out through the hole 250, external to the slip cover 50. Both the convertible slip cover 50 and the convertible stuffed animal and pillow toy 90 are folded along invisible fold line/spine/longitudinal axis 134, 234. The opposite sides 130, 132, 230, 232 are coupled adjacent to each other via fasteners 152, 256 with the connecting strap 150 along the bottom surface 242 of the slip cover 150. Alternatively, with respect to the embodiment of the slip cover in FIG. 6, opposite sides 230, 232 are coupled adjacent to each other via fasteners 253, 255 with the connecting strap 251 along the bottom surface 242 of the slip cover 150. In the stuffed animal configuration 194, the first side members 136, 236 and the second side member 138, 238 form an angle with each other (i.e., no longer substantially coplanar) with the invisible fold line/spine/longitudinal axis 134, 234 forming the vertex of the angle. In addition to holding opposite sides 130, 132, 230, 232 together, tension on the opposite sides 130, 132, 230, 232 caused by the connecting strap 150 causes the opposite sides 130, 132, 230, 232 to arch (concave upwards) as shown in FIG. 3A, giving the toy 90 the appearance of a four-legged animal body. In this configuration 194, the child can play with the toy 90 as with any stuffed animal and the child can easily and conveniently carry the toy 90 around with the handle 243. When the toy 90 is carried via the handle 243 in the stuffed animal configuration/mode 194, the opposite sides 130, 132, 230, 232 are coupled adjacent to each other, causing the formerly co-planar and inwardly facing pockets 244, 245 to now be substantially vertical extending pockets 244, 245 (with the open inner ends 247 facing upwardly) as shown in FIGS. 3C, 3I, and 3J, allowing the child to carry items around with the convertible slip cover 50. In this configuration 194, the stuffed animal/pillow appears to be wearing a "pet outfit" or clothing or other covering.

Then, at optional step 430, fasteners 152, 256 are detached, de-coupling the opposite sides 130, 132, 230, 232 and allowing the pillow toy 90 (donned with the slip cover 50, 239, 350) to automatically spring back to its normal or home pillow configuration 192.

Then, at optional step 440, the slip cover 50, 239, 350 is removed from the pillow toy 90 by respectively detaching the first and second sets of hook and loop fastener members 250, 254 at the first shoulder(s) 222 and the second shoulder(s) 224, opening the top end 220, and removing the pillow toy 90 from the slip cover 50, 239, 350.

Then, at optional step 450, where the slip cover is a reversible convertible slip cover 350, the hook and loop fasteners are unfastened, and the convertible slip cover 350 is removed from the toy 90. Next, the convertible slip cover 350 is reversed as shown in FIGS. 4A-4C, and control proceeds back to donning step 410. With the reversible convertible slip cover 350, instead of a single pillow configuration appearance/outfit 192 and a single stuffed animal configuration appearance/outfit 194, there are two pillow configuration appearances/outfits 192 and two stuffed animal configuration appearance/outfit 194.

Then, at optional step 460, the slip cover 50, 239, 350 is washed/cleaned, and control proceeds back to donning step 410.

Then, at optional step 470, the slip cover 50, 239, 350 is replaced with a different slip cover 50, 239, 350 or the washed/cleaned slip cover 50, 239, 350, and control proceeds back to donning step 410.

Thus, the convertible slip cover 50, 239, 350 covers the pillow toy 90 so that the child rests one face/head directly on the convertible slip cover 50, 239, 350 instead of the possibly contaminated surface of the pillow toy 90. Not only can the convertible slip cover 50, 239, 350 be used to protect the child, but the convertible slip cover 50, 239, 350 can also be used to keep the pillow toy 90 clean. Further, the convertible slip cover 50, 239, 350 is quickly and easily removable/interchangeable, the convertible slip cover 50, 239, 350 is much easier to wash/dry then the convertible stuffed animal and pillow 90, the convertible slip cover 50, 239, 350 can be donned on and is convertible with the convertible stuffed animal toy 90 in both the pillow configuration and the stuffed animal configuration, and/or the convertible slip cover 50, 239, 350 allows for the arching (concave upwards) of the toy 90 in the animal configuration so that the toy 90 still has an animal body appearance.

Figure 7:
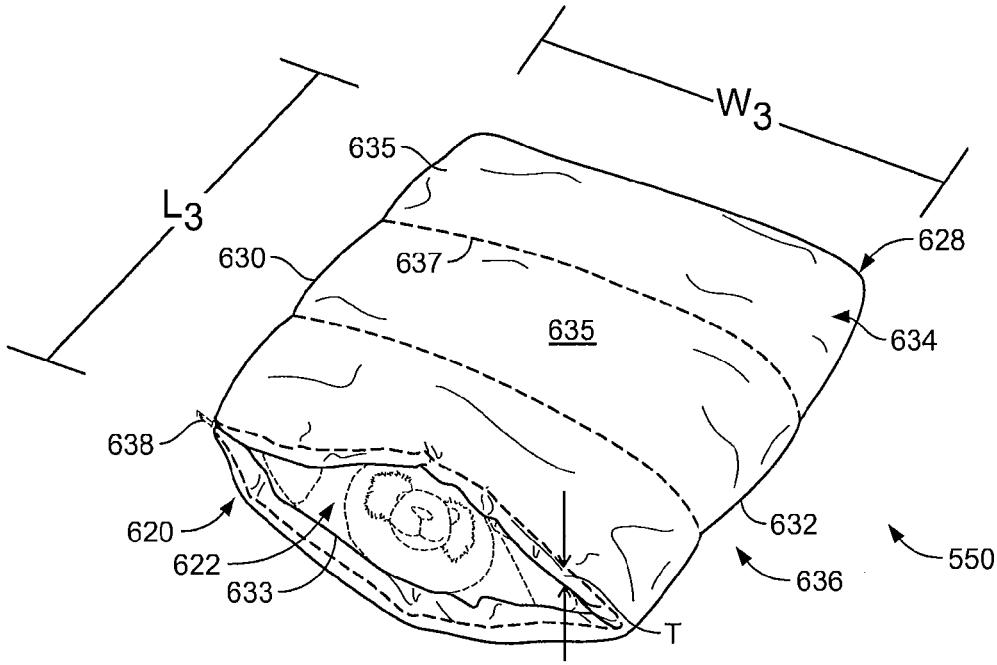
FIG. 7 is a perspective view of a further embodiment a reversible convertible slip cover for the convertible stuffed animal and pillow toy.

FIG. 7 is a perspective view of a further embodiment of a reversible convertible slip cover 550 for the convertible stuffed animal and pillow toy 90. The embodiment of the reversible convertible slip cover 550 shown has a substantially square configuration (from a top view looking down). The convertible slip cover 550 includes a front/top end 620 with an opening 622, a bottom/rear end 628, first side 630, second side 632, interior surface 633, and exterior surface 635. In the embodiment shown, the lengths of the opposite sides 630, 632 (i.e., longitudinal length L3 of the convertible slip cover 550) are the same. The lengths of the ends 620, 628 (i.e., width W3 of the convertible slip cover 550) are the same. In the embodiment shown, the width W3 is the substantially the same as the length L3 (L3/W3=1) with the width W3 and the length L3 being about 20 in./50 cm. In the embodiment shown the length L3 is preferably 20 cm to 60 cm and the width W3 is preferably 35 cm to 65 cm. In alternative embodiments, the dimensions are other than those described above. For example, in an alternative embodiment, the length L3 and width W3 are 32 cm and L3 ranges from 22 cm to 42 cm and W3 ranges from 22 cm to 42 cm. In further embodiments, the length L3 is longer than the width W3 or the width W3 is longer than the length L3. The reversible convertible slip cover 550 includes a top member 634 comprised of multiple panels 635 separated by stitching 637 and a bottom member 636 comprised of multiple panels separated by stitching that define respective substantially parallel planes (when reversible convertible slip cover 550 is not donned on the pillow toy 90) and are detachably connected to each other via reversible zipper 638 disposed along rear end 628 and first side 630. In an alternative embodiment, the top member 634 and the bottom member 636 are detachably connected via zipper 638 along only first side 630. The members 634, 636 are each stuffed with a stuffing (e.g., Polyester fiber batting) and include a thickness T that is preferably about 1.0 in. or 2.5 cm and preferably ranges from 1.5 cm to 3.0 cm. A ratio of the length L3 to thickness T (L3/T) is preferably 10-30.

In use, the reversible convertible slip cover 550 is donned on the convertible stuffed animal and pillow toy 90 by inserting the convertible stuffed animal and pillow toy 90 into the reversible convertible slip cover 550 via the opening 622 so that preferably the head 110 extends at least partially out of the opening 110, exterior to the cover 550. To reverse the slip cover 550, the toy 90 is removed from the cover 550, the zipper 638 is unzipped, the members 634, 636 are folded and rotated/away from each other and towards each other through 360 degree angle/range with second side 632 forming the fold line/hinge line, and the zipper 638 is re-zipped so that former interior surface 633 now becomes exterior surface 635 and vice versa. During the reversing process, at an intermediate point in the process when the zipper 638 is fully unzipped and the members 634, 636 are folded and rotated/away from each other 180 degree angle/range with second side 632, the member 634, 636 are coplanar and have an elongated rectangular configuration with a longitudinal length that is twice the length of W3. In this configuration, the cover 550 can be used as a play pad/surface.

Figure 8:
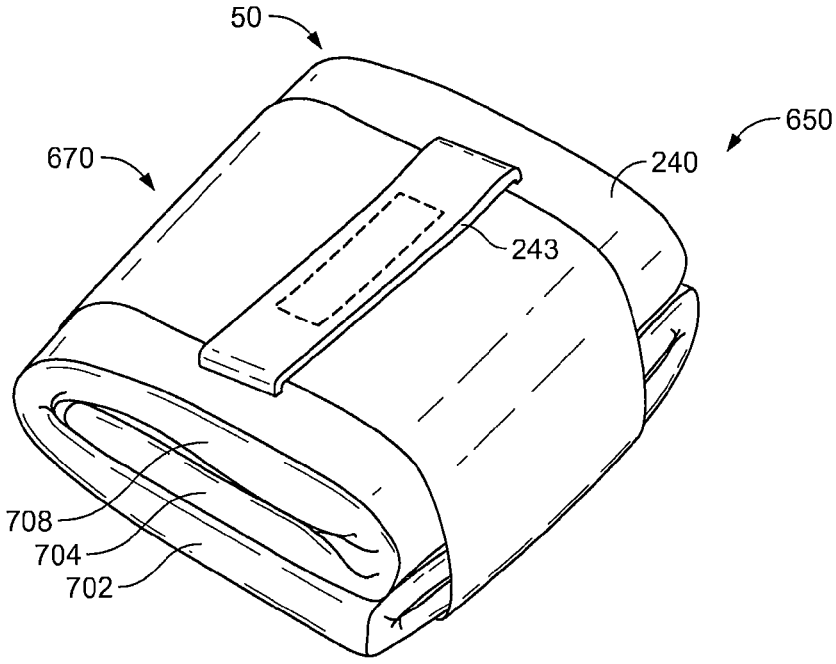
FIG. 8 is a perspective view of the convertible slip cover of FIGS. 2A-2F shown in a compact folded configuration.

FIG. 8 is a perspective view of an embodiment of a convertible slip cover folded assembly 650. In the folded assembly, the convertible slip cover 50 of FIGS. 2A-2F is in a compacted, folded configuration with a band 670 encircling the folded cover 50 with the band threaded between the handle 243 (and perpendicular with respect to the handle 243) and the top surface 240, at a center of the cover 50. The band 670 not only holds the folded cover 50 together to prevent the cover 50 from unfolding, but also may function as a substrate for advertising indicia. The exposed handle 243 may serve as a handle for carrying the folded cover 50, and for hanging the cover 50 for retail display/merchandising. With reference additionally to FIG. 2B, to assemble the convertible slip cover 50 into the configuration shown in FIG. 8, the cover 50 is folded at multiple steps 180 degrees along fold/hinge lines 680, 682, 684, 686 out of the page (towards the reader) or rearward with respect to the cover 50 towards/onto bottom surface 242. The fold lines 680, 682, 684, 686 divide the cover 50 into longitudinally elongated thirds 694, 696, 698 and laterally elongated thirds 688, 690, 692. Thirds 688, 692 have a length L4 that is substantially one half the length of third 690 and thirds 694, 696, 698 have substantially the same width W4.

In an exemplary method of assembly, top laterally elongated third 688 and bottom laterally elongated third 692 are folded rearward and inward 180 degrees (out of and then into the page), one at a time, along fold lines 680, 682 so that thirds 688, 692 respectively overlap top one half and bottom one half of third 690. Then, third 694 of the resulting folded assembly is folded rearward and inward 180 degrees (out of and then into the page) along fold line 684 so that it overlaps center section 700 and then the other third 698 is folded rearward and inward 180 degrees (out of and then into the page) along fold line 686 so that it also overlaps the center section 700 to create the folded assembly having a substantially rectangular configuration (from top/bottom views) and overlapping folds 702, 704, 706 that also respectively define parallel planes as shown in FIG. 8. Then, the band 670 is threaded between the handle 243 (and perpendicular with respect to the handle 243) and the top surface 240, at the center of the of the cover 50, and wrapped around the folded assembly 650 and secured together near opposite ends to secure the folded assembly 650 in the folded configuration.

In one or more additional embodiments/implementations, one or more of the features shown and/or described with respect to one or more of the embodiment(s) and/or implementation(s) shown and/or described herein and/or incorporated by reference herein are combined with one or more other embodiment(s) and/or implementation(s) and/or one or more elements/features shown and/or described herein are removed/deleted from an embodiment/implementation.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The drawings are not necessarily to scale for one or more of the embodiment(s). The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

As will become apparent to one of ordinary skill in the art after reading this document, the illustrated embodiments and their various alternatives can be implemented without confinement to the illustrated examples.

I claim:

1. A method of using a convertible slip cover with a convertible stuffed animal and pillow toy, the convertible stuffed animal and pillow toy including a rectangular pillow body with a front end, a rear end, a first side, a second side, a top surface, a bottom surface, a head extending from the front end, a first shoulder, a second shoulder co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are co-planar, and a stuffed animal configuration mode where the first side member and the second side member are folded about the invisible fold line so that the first side member and the second side member form an angle relative to each other with the invisible fold line forming the vertex of the angle, the connecting strap adapted to couple the first side to the second side along the bottom surface, the convertible slip cover having a rectangular configuration and including a front end, a rear end, a first side, a second side, a top surface, a bottom surface, a neck opening, a first shoulder, a second shoulder co-linear with the front end, an invisible fold line separating the convertible slip cover into a first side member and a second side member, the method comprising:

donning the convertible slip cover onto the convertible stuffed animal and pillow toy in the pillow configuration so that the rectangular pillow body and connecting strap of the convertible stuffed animal and pillow toy are disposed within the convertible slip cover, the first and second shoulders of the convertible stuffed animal and pillow toy are covered by the first and second shoulders of the convertible slip cover, and the head of the convertible stuffed animal and pillow toy extends through the neck opening of the convertible slip cover;

folding the convertible stuffed animal and pillow toy and the convertible slip cover about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles;

coupling the first side of the convertible slip cover and the second side of the convertible slip cover together so that the first and second sides of the convertible slip cover and the convertible stuffed animal and pillow toy are arched concave upwards and the convertible stuffed animal and pillow toy and the convertible slip cover are in a stuffed animal configuration;

wherein the first side of the convertible slip cover includes a side hole and the slip cover includes a fastener adjacent to the second side of the convertible slip cover and the method further includes drawing the connecting strap extending from the first side of the convertible stuffed animal and pillow toy and disposed within the convertible slip cover through the side hole of the convertible slip cover so that the connecting strap extends outside of the convertible slip cover, and coupling the first side of the convertible slip cover and the second side of the convertible slip cover together includes fastening the fastener of the distal end of the connecting strap to the fastener adjacent to the second side of the convertible slip cover.

2. The method of claim 1, wherein the convertible stuffed animal and pillow toy includes a longitudinal length L1 and a width W1, the convertible slip cover includes a longitudinal length L2 and a width W2, and W2/L1 is 1.02-1.75, W2/W1 is 0.75-1.25, and L2/L1 is 0.75-1.45.

3. The method of claim 1, wherein the front end of the convertible stuffed animal and pillow toy includes a neck with a width N1 and the front end of the convertible slip cover includes a neck with a width N2, and N2/N1 is 0.5-1.5.

4. The method of claim 1, wherein the convertible slip cover includes an open top end and the first shoulder and the second shoulder of the convertible slip cover include fastener members, and donning includes inserting the rectangular pillow body through the open top end until the first shoulder and the second shoulder of the rectangular pillow body are aligned with the first shoulder and the second shoulder of the convertible slip cover and further including fastening the first shoulder and the second shoulder of the convertible slip cover together with the fastener members of the first shoulder and the second shoulder of the convertible slip cover so that the first and second shoulders of the convertible stuffed animal and pillow toy are covered by the first and second shoulders of the convertible slip cover, and the neck of the top end of the convertible slip cover is secured around the neck of the convertible stuffed animal and pillow toy.

5. The method of claim 1, wherein the top surface of the convertible slip cover includes at least one pocket that is horizontally oriented in the pillow configuration and vertically oriented in the stuffed animal configuration.

6. The method of claim 5, wherein the at least one pocket includes a pair of pockets, each including an inner end opening, the pockets being co-planar with each other in the pillow configuration and vertically oriented in the stuffed animal configuration with the inner end openings oriented upward.

7. A method of using a convertible slip cover with a convertible stuffed animal and pillow toy, the convertible stuffed animal and pillow toy including a rectangular pillow body with a longitudinal length L1, width W1, a front end, a rear end, a first side, a second side, a top surface, a bottom surface, a head extending from the front end, a first shoulder, a second shoulder co-linear with the front end and the first shoulder, a connecting strap extending from the first side and including a distal end with a fastener, an invisible fold line separating the pillow body into a first side member and a second side member, the convertible stuffed animal and pillow toy including a pillow configuration mode where the first side member and the second side member are co-planar, and a stuffed animal configuration mode where the first side member and the second side member are folded about the invisible fold line so that the first side member and the second side member form an angle relative to each other with the invisible fold line forming the vertex of the angle, the connecting strap adapted to couple the first side to the second side along the bottom surface, the convertible slip cover having a rectangular configuration and including a longitudinal length L2, a width W2, a front end, a rear end, a first side, a second side, a top surface, a bottom surface, a neck opening, a first shoulder, a second shoulder co-linear with the front end, an invisible fold line separating the convertible slip cover into a first side member and a second side member, and W2/L1 is 1.02-1.75, W2/W1 is 0.75-1.25, and L2/L1 is 0.75-1.45, the method comprising:

in a pillow configuration mode:

inserting the convertible stuffed animal and pillow toy in the pillow configuration into the convertible slip cover so that the rectangular pillow body and connecting strap of the convertible stuffed animal and pillow toy are disposed within the convertible slip cover, the first and second shoulders of the convertible stuffed animal and pillow toy are covered by the first and second shoulders of the convertible slip cover, and the head of the convertible stuffed animal and pillow toy extends through the neck opening of the convertible slip cover;

in a stuffed animal configuration mode:

folding the convertible stuffed animal and pillow toy and the convertible slip cover about the invisible fold lines of the convertible stuffed animal and pillow toy and the convertible slip cover so that the first side members and the second side members of the convertible stuffed animal and pillow toy and the convertible slip cover form angles relative to each other with the invisible fold lines forming the vertices of the angles;

coupling the first side of the convertible slip cover and the second side of the convertible slip cover together so that the first and second sides of the convertible slip cover and the convertible stuffed animal and pillow toy are arched concave upwards and the convertible stuffed animal and pillow toy and the convertible slip cover are in a stuffed animal configuration;

wherein the first side of the convertible slip cover includes a side hole and the slip cover includes a fastener adjacent to the second side of the convertible slip cover and the method further includes drawing the connecting strap extending from the first side of the convertible stuffed animal and pillow toy and disposed within the convertible slip cover through the side hole of the convertible slip cover so that the connecting strap extends outside of the convertible slip cover, and coupling the first side of the convertible slip cover and the second side of the convertible slip cover together includes fastening the fastener of the distal end of the connecting strap to the fastener adjacent to the second side of the convertible slip cover.

8. The method of claim 7, wherein the front end of the convertible stuffed animal and pillow toy includes a neck with a width N1 and the front end of the convertible slip cover includes a neck with a width N2, and N2/N1 is 0.5-1.5.

9. The method of claim 7, wherein the convertible slip cover includes an open top end and the first shoulder and the second shoulder of the convertible slip cover include fastener members, and inserting includes inserting the rectangular pillow body through the open top end until the first shoulder and the second shoulder of the rectangular pillow body are aligned with the first shoulder and the second shoulder of the convertible slip cover and further including fastening the first shoulder and the second shoulder of the convertible slip cover together with the fastener members of the first shoulder and the second shoulder of the convertible slip cover so that the first and second shoulders of the convertible stuffed animal and pillow toy are covered by the first and second shoulders of the convertible slip cover, and the neck of the top end of the convertible slip cover is secured around the neck of the convertible stuffed animal and pillow toy.

10. The method of claim 7, wherein the top surface of the convertible slip cover includes at least one pocket that is horizontally oriented in the pillow configuration and vertically oriented in the stuffed animal configuration.

11. The method of claim 10, wherein the at least one pocket includes a pair of pockets, each including an inner end opening, the pockets being co-planar with each other in the pillow configuration and vertically oriented in the stuffed animal configuration with the inner end openings oriented upward.

12. A method of using a slip cover with a stuffed animal pillow toy convertible between a generally flat, pillow configuration for use as a pillow and a folded, stuffed animal configuration in which first and second side portions of the toy are folded towards one another about a central longitudinal axis of the toy extending between opposite ends of the toy and secured together in the folded configuration, the method comprising:

inserting a stuffed animal pillow toy in a generally flat, pillow configuration through an end opening of a slip cover so that a rectangular pillow body and connecting strap of the stuffed animal pillow toy are disposed within the slip cover and a head of the convertible stuffed animal pillow toy extends through the end opening of the slip cover, forming a covered stuffed animal pillow toy;

folding the covered stuffed animal pillow toy about a central longitudinal axis into a folded, stuffed animal configuration in which first and second opposite side portions of the covered stuffed animal pillow toy form an angle relative to each other with the central longitudinal axis at the vertex;

coupling the first side portion to the second side portion to hold the covered stuffed animal pillow toy in the folded stuffed animal configuration; and releasing the first side portion from the second side portion and unfolding the covered stuffed animal toy into a generally flat, pillow configuration in order to use the covered toy as a pillow;

wherein the first side of the convertible slip cover includes a side hole and the slip cover includes a fastener adjacent to the second side of the convertible slip cover and the method further includes drawing the connecting strap extending from the first side of the convertible stuffed animal and pillow toy and disposed within the convertible slip cover through the side hole of the convertible slip cover so that the connecting strap extends outside of the convertible slip cover, and coupling the first side of the convertible slip cover and the second side of the convertible slip cover together includes fastening the fastener of the distal end of the connecting strap to the fastener adjacent to the second side of the convertible slip cover.

13. The method of claim 12, further comprising drawing the connecting strap of the stuffed animal pillow toy through a side hole in the slip cover prior to folding the covered stuffed animal pillow toy into the folded, stuffed animal configuration, the strap extending from the first side portion of the covered stuffed animal pillow toy in the folded configuration, and the step of coupling the first side portion to the second side portion comprising securing a fastener end of the strap to a fastener located on the slip cover in the second side portion of the folded, covered stuffed animal pillow toy.

14. The method of claim 12, wherein the stuffed animal pillow toy includes a longitudinal length L1 and a width W1, the slip cover includes a longitudinal length L2 and a width W2, and W2/L1 is 1.02-1.75, W2/W1 is 0.75-1.25, and L2/L1 is 0.75-1.45.

15. The method of claim 12, wherein the stuffed animal pillow toy includes a front end having a neck with a width N1 and the slip cover includes a front end having a neck with a width N2, and N2/N1 is 0.5-1.5.

* * * * *